US010707035B2

(12) United States Patent
Tokoi et al.

(10) Patent No.: US 10,707,035 B2
(45) Date of Patent: Jul. 7, 2020

(54) ROTARY ELECTRONIC COMPONENT

(71) Applicant: Murata Manufacturing Co., Ltd., Nagaokakyo-shi, Kyoto-fu (JP)

(72) Inventors: Shogo Tokoi, Nagaokakyo (JP); Sachie Osakatani, Nagaokakyo (JP); Toshiki Nishiwaki, Nagaokakyo (JP); Osamu Nakao, Nagaokakyo (JP); Takeshi Takeda, Nagaokakyo (JP); Yoshiaki Nomura, Nagaokakyo (JP); Hiroyuki Kishishita, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 78 days.

(21) Appl. No.: 16/143,529

(22) Filed: Sep. 27, 2018

(65) Prior Publication Data

US 2019/0035576 A1 Jan. 31, 2019

Related U.S. Application Data

(63) Continuation of application No. PCT/JP2017/009460, filed on Mar. 9, 2017.

(30) Foreign Application Priority Data

Mar. 30, 2016 (JP) ..... 2016-069272

(51) Int. Cl.

| | |
|---|---|
| ***H01H 25/06*** | (2006.01) |
| ***H01H 19/11*** | (2006.01) |
| *H01H 19/00* | (2006.01) |

(52) U.S. Cl.

CPC ..... *H01H 25/06* (2013.01); *H01H 19/11* (2013.01); *H01H 19/005* (2013.01);
(Continued)

(58) Field of Classification Search

CPC ..... H01H 25/06; H01H 19/11; H01H 19/005; H01H 2019/006; H01H 2215/03;
(Continued)

(56) References Cited

U.S. PATENT DOCUMENTS 6,396,006 B1 * 5/2002 Yokoji ..... G06F 3/0312 200/11 R
7,812,270 B2 * 10/2010 Tan ..... H01H 25/008 200/4

(Continued)

FOREIGN PATENT DOCUMENTS

| | | |
|---|---|---|
| JP | 2001-243849 A | 9/2001 |
| JP | 2004-095242 A | 3/2004 |
| JP | 2011-238447 A | 11/2011 |

OTHER PUBLICATIONS

Official Communication issued in International Patent Application No. PCT/JP2017/009460, dated May 16, 2017.

(Continued)

*Primary Examiner* — Edwin A. Leon
(74) *Attorney, Agent, or Firm* — Keating & Bennett, LLP

(57) ABSTRACT

A rotary electronic component includes a base member, a shaft attached to the base member so as to be rotatable around an axis, and a regulating member that regulates a rotation angle of the shaft. The shaft includes a flange section including a projecting sections and recessed sections alternately disposed in a circumferential direction. The regulating member includes a contact member in contact with the projecting sections and the recessed sections of the flange section of the shaft, and a biasing member that biases the contact member radially inwardly toward the shaft.

17 Claims, 20 Drawing Sheets

(52) U.S. Cl.
CPC ... *H01H 2019/006* (2013.01); *H01H 2215/03* (2013.01); *H01H 2221/01* (2013.01); *H01H 2223/008* (2013.01); *H01H 2225/004* (2013.01); *H01H 2225/03* (2013.01); *H01H 2239/026* (2013.01)

(58) Field of Classification Search
CPC ..... H01H 2221/01; H01H 2223/008; H01H 2225/004; H01H 2225/03; H01H 2239/026
USPC ..... 200/293, 4, 5 R, 6 R, 11 R, 14, 11 A, 200/11 D, 11 DA, 11 TW, 6 A, 6 C, 16 R, 200/16 A, 16 B, 16 C, 17 R
See application file for complete search history.

(56) References Cited

U.S. PATENT DOCUMENTS

| | | | | |
|---|---|---|---|---|
| 8,035,043 | B2 * | 10/2011 | Asada | H01H 25/06 200/6 A |
| 8,440,925 | B2 * | 5/2013 | Chung | H01H 25/06 200/316 |
| 2001/0024156 | A1 | 9/2001 | Kuratani | |
| 2004/0041086 | A1 | 3/2004 | Imamura | |
| 2006/0060454 | A1 * | 3/2006 | Imamura | G01D 5/34738 200/14 |

OTHER PUBLICATIONS

Official Communication issued in corresponding Japanese Patent Application No. 2018-508913, dated Oct. 9, 2018.

* cited by examiner

ROTARY ELECTRONIC COMPONENT

CROSS REFERENCE TO RELATED APPLICATIONS

This application claims the benefit of priority to Japanese Patent Application No. 2016-069272 filed on Mar. 30, 2016 and is a Continuation Application of PCT Application No. PCT/JP2017/009460 filed on Mar. 9, 2017. The entire contents of each application are hereby incorporated herein by reference.

BACKGROUND OF THE INVENTION

1. Field of the Invention

The present invention relates to a rotary electronic component.

2. Description of the Related Art

A conventional rotary electronic component is described in Japanese Patent Application Laid-Open No. 2004-095242. This rotary electronic component includes a shaft, a regulating member that regulates a rotation angle of the shaft, and an encoder mechanism that detects a rotation direction and a rotation angle of the shaft.

The encoder mechanism of the conventional rotary electronic component includes a rotor attached to the shaft, and a slider attached to the rotor. The regulating member is in contact with an outer peripheral surface of the rotor to regulate a rotation angle of the shaft.

In the conventional rotary electronic component, the regulating member regulates a rotation angle of the shaft by allowing a ball to be in contact with an outer peripheral surface of the rotor. Specifically, the ball pressed by the regulating member moves into a recessed section on an outer periphery of the rotor, and is elastically pressed to be held. Reduction in size in this structure is difficult to achieve, since high machining accuracy and assembling accuracy are required for each component. Reliability is also difficult to obtain in reduction in size in the structure.

SUMMARY OF THE INVENTION

Preferred embodiments of the present invention provide rotary electronic components that are able to be reduced in size.

A rotary electronic component according to a preferred embodiment of the present invention includes a base member, a shaft attached to the base member so as to be rotatable around an axis, and a regulating member that regulates a rotation angle of the shaft. The shaft includes a flange section including a plurality of projecting sections and recessed sections disposed alternately in a circumferential direction. The regulating member includes a contact member in contact with the projecting sections and the recessed sections of the shaft, and a biasing member that biases the contact member radially inwardly toward the shaft.

In the rotary electronic component, the contact member of the regulating member is biased by the biasing member radially inwardly toward the shaft so as to be in contact with the projecting sections of the flange section of the shaft so as to bias the projecting sections, and is fitted into the recessed sections of the flange section of the shaft so as to regulate a rotation angle of the shaft. In this manner, the regulating member that regulates a rotation angle of the shaft is reduced in size with a simple configuration. As a result, a reduction in size of the rotary electronic component is achieved.

By providing an encoder mechanism that detects a rotation direction and a rotation angle of the shaft, a rotary encoder with a reduced size is provided.

A switch mechanism that is pressed against the shaft by moving along an axis of the shaft may also be provided. The shaft is able to perform both regulating operation of a rotation angle and switching operation in an axial direction.

According to a preferred embodiment of the rotary electronic component, the contact member includes a first end rotatably connected to the base member, and a second free end in contact with the projecting sections and the recessed sections of the shaft, and the biasing member is locked on the free end of the contact member.

According to the above-described preferred embodiment, the first end of the contact member is rotatably connected to the base member, and the second end of the contact member is a free end in contact with the projecting sections and the recessed sections of the shaft. The biasing member is locked on the free end of the contact member. Accordingly, the free end of the contact member is restricted to rotate on an arc, and a behavior of the contact member accompanying rotation of the shaft is stabilized. In this manner, a smooth click feeling is obtained.

According to a preferred embodiment of the rotary electronic component, the contact member of the regulating member includes a first contact member and a second contact member disposed on both sides of the shaft. The biasing member of the regulating member includes a base section which is elastically deformable, a first locking section provided at a first end of the base section so as to be locked on a free end of the first contact member, and a second locking section provided at a second end of the base section so as to be locked on a free end of the second contact member.

According to the above-described preferred embodiment, the biasing member including the base section which is elastically deformable and the first and second locking sections locked on the free end of the first and second contact members biases the first and second contact members of the regulating member radially inwardly toward the shaft so as to be in contact with the projecting sections and the recessed sections of the flange section from both sides of the shaft. Accordingly, a smooth click feeling is obtained similarly in both rotation directions of the shaft.

According to a preferred embodiment of the rotary electronic component, the first contact member and the second contact member of the regulating member are disposed at positions that are plane-symmetric with respect to a plane passing through an axis of the shaft.

According to the above-described preferred embodiment, the first contact member and the second contact member of the regulating member are disposed at positions that are plane-symmetric with respect to a plane passing through an axis of the shaft. In this manner, states of the first contact member and the second contact member in contact with the projecting sections and the recessed sections of the flange section of the shaft are synchronous. Accordingly, a smoother click feeling is obtained.

According to a preferred embodiment of the rotary electronic component, the projecting sections of the flange section of the shaft are disposed at positions that are plane-symmetric with respect to a plane passing through an axis of the shaft, and the recessed sections of the flange section of the shaft are disposed at positions that are plane-symmetric with respect to a plane passing through an axis of the shaft.

According to the above-described preferred embodiment, the projecting sections of the flange section of the shaft are disposed at positions that are plane-symmetric with respect to a plane passing through an axis of the shaft, and the recessed sections of the flange section of the shaft are disposed at positions that are plane-symmetric with respect to a plane passing through an axis of the shaft. In this manner, states of the first contact member and the second contact member in contact with the projecting sections and the recessed sections of the flange section of the shaft are synchronous. Accordingly, a smoother click feeling is obtained.

According to a preferred embodiment of the rotary electronic component, the biasing member of the regulating member is provided on the base member such that the entire or substantially the entire biasing member is movable within a predetermined range.

According to the above-described preferred embodiment, the biasing member of the regulating member is provided on the base member such that the entire or substantially the entire biasing member is movable within a predetermined range. Accordingly, the entire or substantially the entire biasing member is elastically deformed in a flexible manner along with rotation of the shaft. In this manner, concentration of stress to the biasing member is relieved, and a fatigue fracture of the biasing member caused by repetition of elastic deformation is prevented.

According to a preferred embodiment of the rotary electronic component, the contact member and the biasing member of the regulating member are locked on curved surfaces in contact with each other.

According to the above-described preferred embodiment, the contact member and the biasing member of the regulating member are locked on curved surfaces in contact with each other. In this manner, a contact area of the contact member and the biasing member is large. As a result, a surface pressure is reduced, wear of a contact surface between the contact member and the biasing member is reduced, and reliability is improved.

According to a preferred embodiment of the rotary electronic component, a movement regulating member that regulates a movement of the regulating member in an axial direction of the shaft is included.

According to the above-described preferred embodiment, the movement regulating member regulates a movement of the regulating member in an axial direction of the shaft. Accordingly, the regulating member does not move irregularly in an axial direction of the shaft along with rotation of the shaft, and have stabilized behaviors.

According to rotary electronic components of preferred embodiments of the present invention, a regulating member that regulates a rotation angle of a shaft is reduced in size with a simple structure. As a result, a reduction in size of the rotary electronic components is achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, detailed description will be provided of preferred embodiments of the present invention with reference to the drawings.

Figure 1:
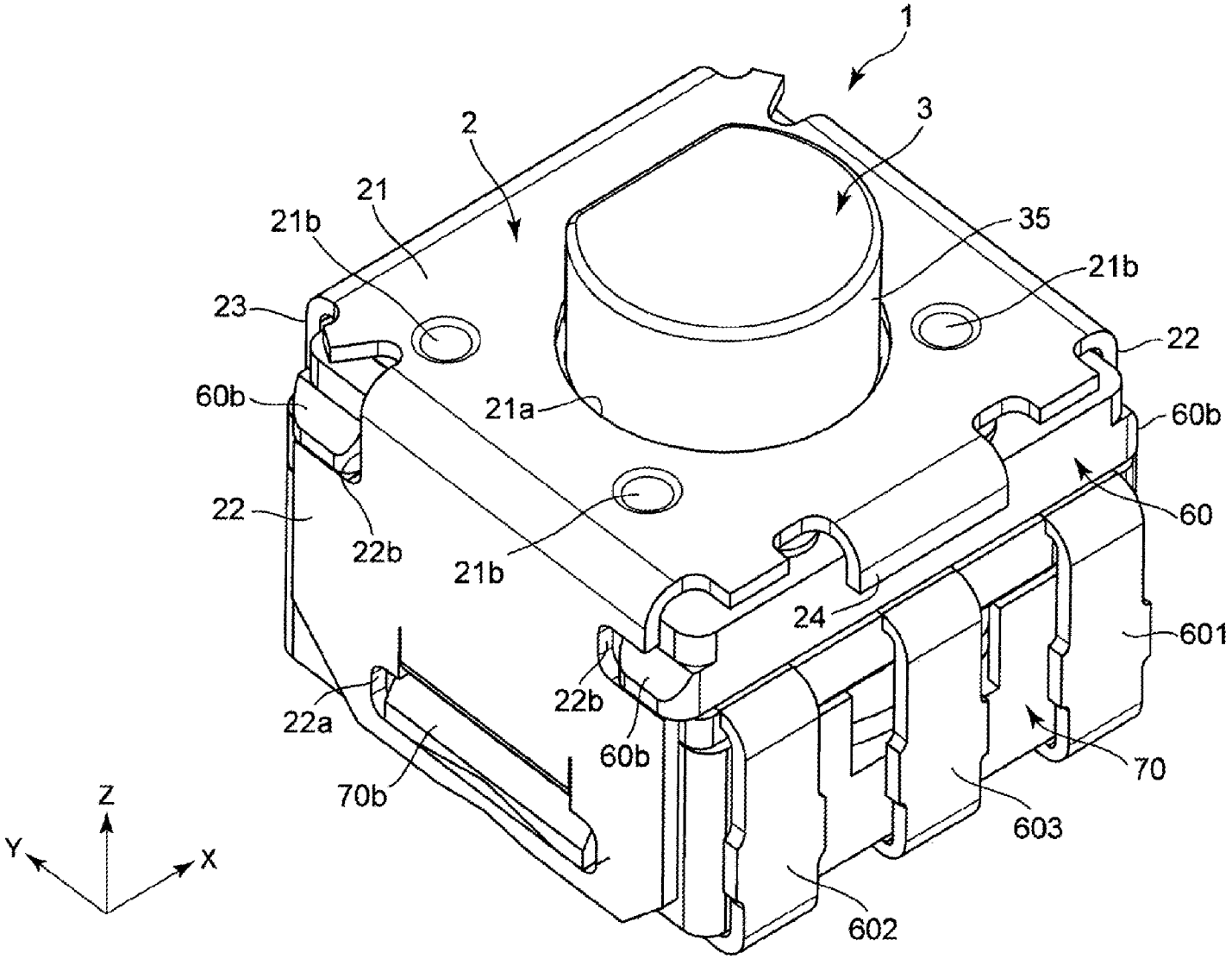
FIG. 1 is a perspective view showing a rotary encoder as an example of a rotary electronic component according to a preferred embodiment of the present invention viewed from above.
Figure 2:
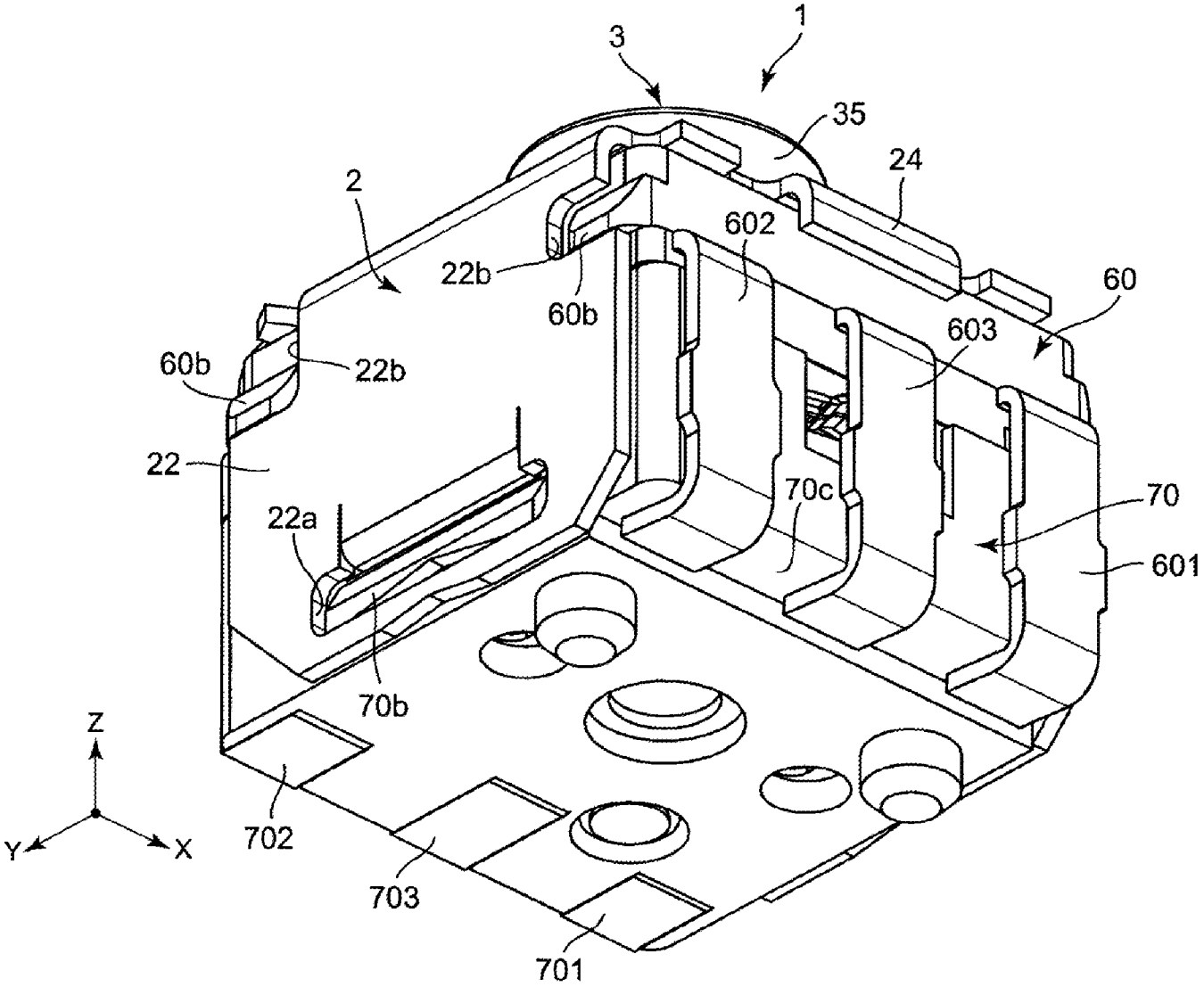
FIG. 2 is a perspective view showing the rotary encoder viewed from below.
Figure 3:
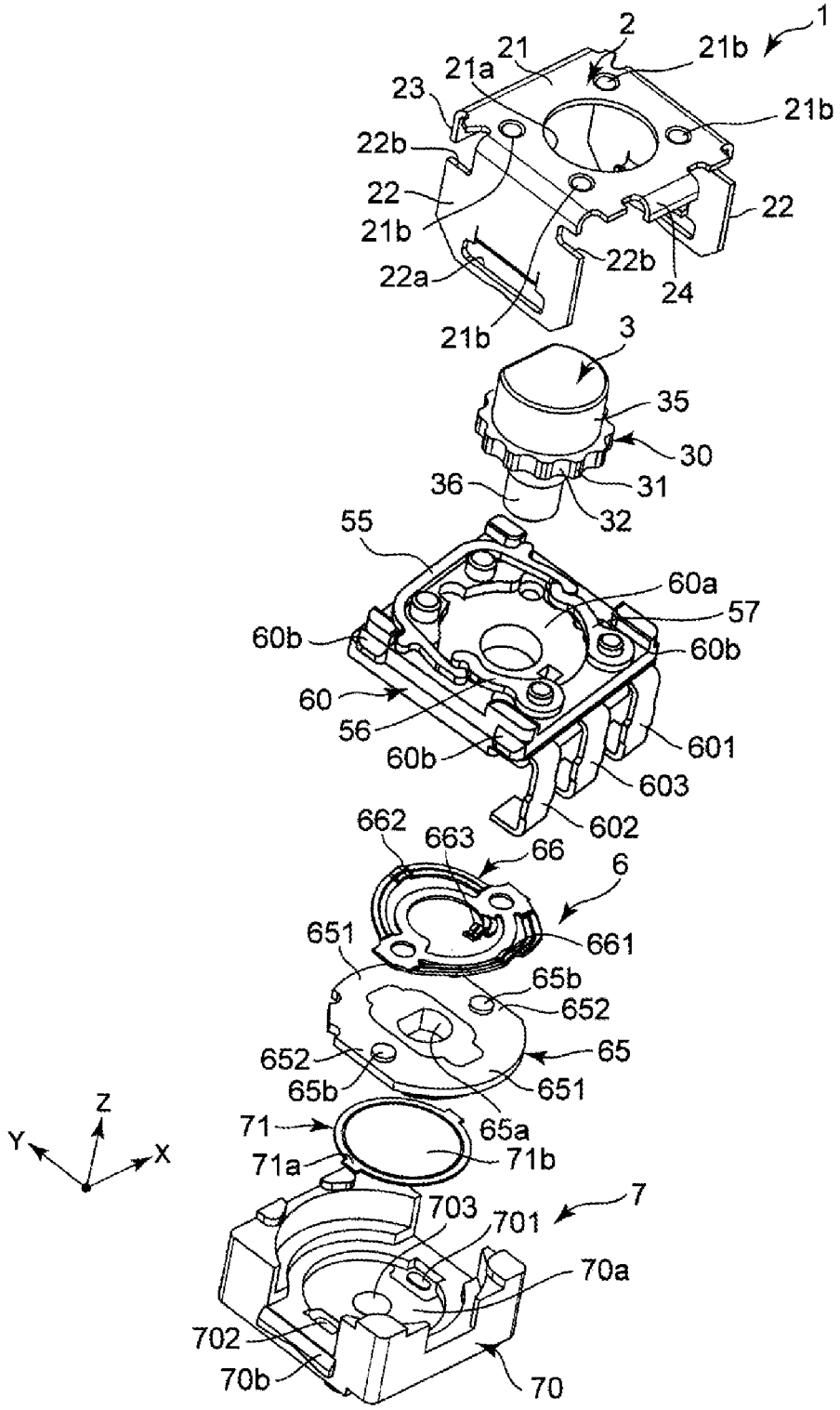
FIG. 3 is an exploded perspective view of the rotary encoder viewed from above.
Figure 4:
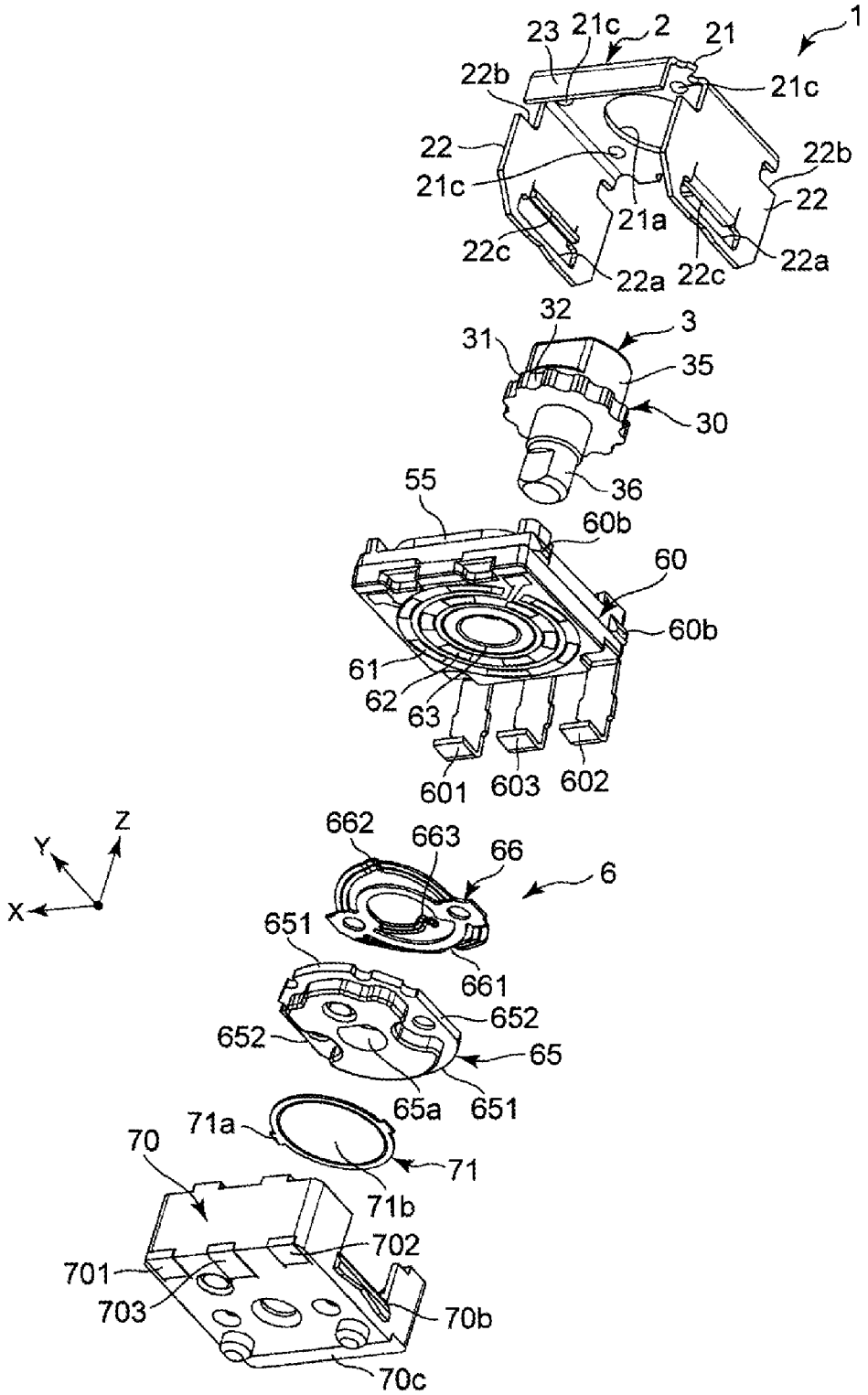
FIG. 4 is an exploded perspective view of the rotary encoder viewed from below.
Figure 5:
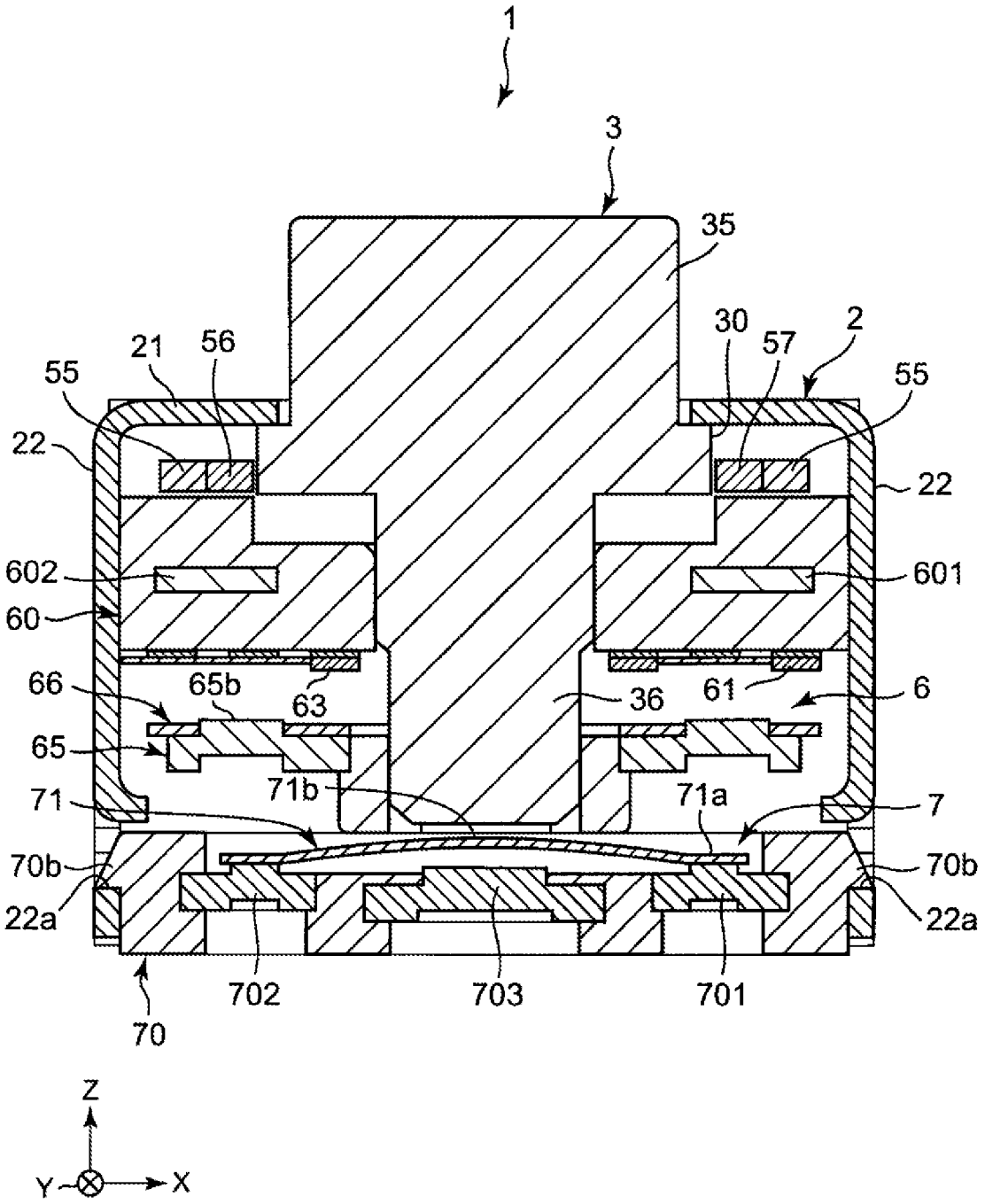
FIG. 5 is a cross-sectional view of the rotary encoder.

FIG. 1 is a perspective view of a rotary encoder 1 as an example of a rotary electronic component according to a preferred embodiment of the present invention viewed from above. FIG. 2 is a perspective view of the rotary encoder 1 viewed from below. FIG. 3 is an exploded perspective view of the rotary encoder 1 viewed from above. FIG. 4 is an exploded perspective view of the rotary encoder 1 viewed from below. FIG. 5 is a cross-sectional view of the rotary encoder 1.

In each of the drawings, a width direction of the rotary encoder 1 is an X direction. A length direction of the rotary encoder 1 is a Y direction. A height direction of the rotary encoder 1 is a Z direction. A positive direction of the Z direction is on an upper side, and a negative direction of the Z direction is on a lower side.

As shown in FIGS. 1 to 5, the rotary encoder 1 includes a casing 2, a shaft 3, a regulating member (a click spring 55 and pendulums 56 and 57), an encoder mechanism 6, and a switch mechanism 7. The shaft 3 is attached to the casing 2 rotatably around an axis and movably along the axis. The regulating member regulates a rotation angle of the shaft 3. The encoder mechanism 6 detects a rotation direction and the rotation angle of the shaft 3. The switch mechanism 7 is pressed against the shaft 3 by moving along the axis of the shaft 3. The regulating member (the click spring 55 and the pendulums 56 and 57), the encoder mechanism 6, and the switch mechanism 7 are disposed in this order from an upper side to a lower side along the axis of the shaft 3. The click spring 55 is an example of a contact member. The pendulum 56 is an example of a first contact member, and the pendulum 57 is an example of a second contact member.

The casing 2 is preferably made from, for example, metal. The casing 2 is assembled integrally with the shaft 3, the regulating member (the click spring 55 and the pendulums 56 and 57), the encoder mechanism 6, and the switch mechanism 7.

The casing 2 includes an upper wall 21, side walls 22 and 22 that are provided on both sides in the X direction of the upper wall 21 and extend in a downward direction, a protruding wall 23 that is provided in the positive direction in the Y direction on the upper wall 21 and extends in a downward direction, and a protruding piece 24 that is provided in the negative direction in the Y direction of the upper wall 21 and extends in a downward direction. The upper wall 21 includes a hole section 21*a* and four recessed sections 21*b* around the hole section 21*a*. The side wall 22 includes a hole section 22*a* on a lower side thereof and a groove section 22*b* on an upper side thereof. A locking section 22*c* projecting to an inner side of the casing 2 is provided on an inner surface of the hole section 22*a*. The protruding wall 23 extends over an entire or substantially entire length in the X direction of the upper wall 21. The protruding piece 24 is provided in a central section in the X direction of the upper wall 21.

The shaft 3 is preferably made from, for example, resin. The shaft 3 includes an operation section 35, a flange section 30 having a gear shape, and an end section 36. The operation section 35, the flange section 30 having a gear shape, and the end section 36 are disposed in this order from an upper side to a lower side along the axis. The operation section 35 includes a notch which is used as a mark for rotation of the shaft 3. The flange section 30 having a gear shape includes a plurality of projecting sections 31 and recessed sections 32. The plurality of projecting sections and recessed sections 32 are disposed alternately in a circumferential direction. The operation section 35 passes through the hole section 21*a* on the upper wall 21 of the casing 2, so that a user is able to operate the operation section 35 from outside the casing 2.

The encoder mechanism 6 includes an encoder board 60 as an example of a base member, resistor patterns 61, 62, and 63 provided on the encoder board 60, encoder terminals 601, 602, and 603 provided on the encoder board 60 and electrically connected to the resistor patterns 61, 62, and 63, a rotor 65 attached to the shaft 3 in a manner rotatable together with the shaft 3, and a slider 66 attached to the rotor 65 and slidably in contact with the resistor patterns 61, 62, and 63.

The encoder board 60 is preferably made from, for example, resin. The regulating member (the click spring 55 and the pendulums 56 and 57) is attached to a top surface 60*a* of the encoder board 60. Protruding sections 60*b* are provided on both sides in the X direction of the encoder board 60. The protruding section 60*b* is fitted to the groove section 22*b* of the side wall 22 of the casing 2. Both sides in the Y direction of the encoder board 60 are sandwiched by the protruding wall 23 and the protruding piece 24. As described above, the encoder board 60 is fixed to the casing 2 by the groove section 22*b* of the side wall 22, the protruding wall 23, and the protruding piece 24. In other words, the groove section 22*b* of the side wall 22, the protruding wall 23, and the protruding piece 24 define an encoder fixing section that fixes the encoder board 60.

The resistor patterns 61, 62, and 63 are provided on a bottom surface of the encoder board 60. The resistor patterns 61, 62, and 63 detect a rotation direction and a rotation angle of the shaft 3. The first resistor pattern 61, the second resistor pattern 62, and the third resistor pattern 63 define an annular shape, and are disposed concentrically. The first resistor pattern 61, the second resistor pattern 62, and the third resistor pattern 63 are disposed in this order from an outer side to an inner side in a radial direction. The first resistor pattern 61 and the second resistor pattern 62 are provided intermittently. The third resistor pattern 63 is provided continuously.

The encoder terminals 601, 602, and 603 are insert-molded on the encoder board 60. The first encoder terminal 601 is electrically connected to the first resistor pattern 61. The second encoder terminal 602 is electrically connected to the second resistor pattern 62. The third encoder terminal 603 is electrically connected to the third resistor pattern 63.

The rotor 65 is positioned in a circumferential direction with respect to the shaft 3, and movable in an axial direction. Specifically, the rotor 65 includes a hole section 65*a* having a D-shape. An outer peripheral surface of the end section 36 of the shaft 3 has a D-shape. The end section 36 having a D-shape is fitted into the hole section 65*a* having a D-shape, and the rotor 65 is fixed in the circumferential direction and not fixed in the axial direction with respect to the shaft 3.

The rotor 65 has an elliptical or substantially elliptical shape. The rotor 65 includes a larger diameter section 651 in which an outside diameter of the rotor 65 is a larger diameter, and a smaller diameter section 652 where an outside diameter of the rotor 65 is a smaller diameter. A length of the larger diameter section 651 is larger than that of a gap between the locking sections 22*c* of the side walls 22 facing each other. A length of the smaller diameter section 652 is smaller than that of the gap between the locking sections 22*c* of the side walls 22 facing each other. In other words, the locking sections 22*c* are structured such that the smaller diameter section 652 is removed without being locked between the locking sections 22*c*, and the larger diameter section 651 is able to be locked between and removed from the locking sections 22*c* by rotation of the rotor 65.

The slider 66 is preferably made from, for example, metal. The slider 66 is fixed to two protruding sections 65*b* on a top surface of the rotor 65. The slider 66 has an annular shape. The slider 66 includes a first contact section 661, a second contact section 662, and a third contact section 663. The first contact section 661, the second contact section 662, and the third contact section 663 are disposed in this order from an outer side to an inner side in a radial direction. The first contact section 661, the second contact section 662, and the third contact section 663 are mutually conductive. The first contact section 661 is able to be in contact with the first resistor pattern 61. The second contact section 662 is able to be in contact with the second resistor pattern 62. The third contact section 663 is able to be in contact with the third resistor pattern 63.

The switch mechanism 7 includes a switch board 70, first to third switch terminals 701, 702, and 703 provided on the switch board 70, and a conductor 71 provided on the switch board 70 and pressed by the end section 36 of the shaft 3. The conductor 71 is electrically connected to the first and second switch terminals 701 and 702. The conductor 71 is pressed by the end section 36 of the shaft 3 so as to be electrically connected to the third switch terminal 703, and provides conduction between the first and second switch terminals 701 and 702 and the third switch terminal 703. When conduction is established between the first and second switch terminals 701 and 702 and the third switch terminal 703, a switch signal becomes ON. For example, when the switch signal becomes ON, each function is operated. Only one of the first and second switch terminals 701 and 702 may be provided.

Protruding sections 70*b* are provided on both sides in the X direction of the switch board 70. The protruding section 70*b* is fitted into the hole section 22*a* of the side wall 22 of the casing 2. In this manner, the switch board 70 is fixed to the casing 2 by the hole section 22*a* of the side wall 22. In other words, the hole section 22*a* of the side wall 22 defines a switch fixing section that fixes the switch board 70.

A step section 70*c* is provided on one side in the X direction on a bottom surface of the switch board 70. End sections of the encoder terminals 601, 602, and 603 which are folded are locked on the step section 70*c*. That is, the encoder board 60 and the switch board 70 are held integrally by the encoder terminals 601, 602, and 603 which are folded.

A depth of the step section 70*c* is larger than a thickness of the encoder terminals 601, 602, and 603. In this manner, when the bottom surface of the switch board 70 is installed on a mounting substrate, the bottom surface of the switch board 70 is able to be used as an installation surface instead of the encoder terminals 601, 602, and 603.

The first to third switch terminals 701, 702, and 703 are insert-molded on the switch board 70. The third switch terminal 703 is positioned between the first switch terminal 701 and the second switch terminal 702.

The conductor 71 is elastic. The conductor 71 has a dome shape. The conductor 71 is fitted into a recessed section 70*a* on a top surface of the switch board 70.

A peripheral section 71*a* of the conductor 71 is electrically connected to the first and second switch terminals 701 and 702. A zenith section 71*b* of the conductor 71 is separated from the third switch terminal 703 when the conductor 71 is in a free state, and electrically connected to the third switch terminal 703 by being pressed by the end section 36 of the shaft 3.

That is, when the shaft 3 is pressed downward, the end section 36 of the shaft 3 presses the zenith section 71*b* of the conductor 71, so that the zenith section 71*b* of the conductor 71 is electrically connected to the third switch terminal 703. In this manner, the first and second switch terminals 701 and 702 and the third switch terminal 703 are electrically connected, and the switch signal becomes ON.

On the other hand, when downward pressing of the shaft 3 is released, the conductor 71 returns to a free state. This allows the shaft 3 to move to an upper side, and the zenith section 71*b* of the conductor 71 is separated from the third switch terminal 703. In this manner, the first and second switch terminals 701 and 702 and the third switch terminal 703 are not electrically connected, and the switch signal becomes OFF.

Figure 6:
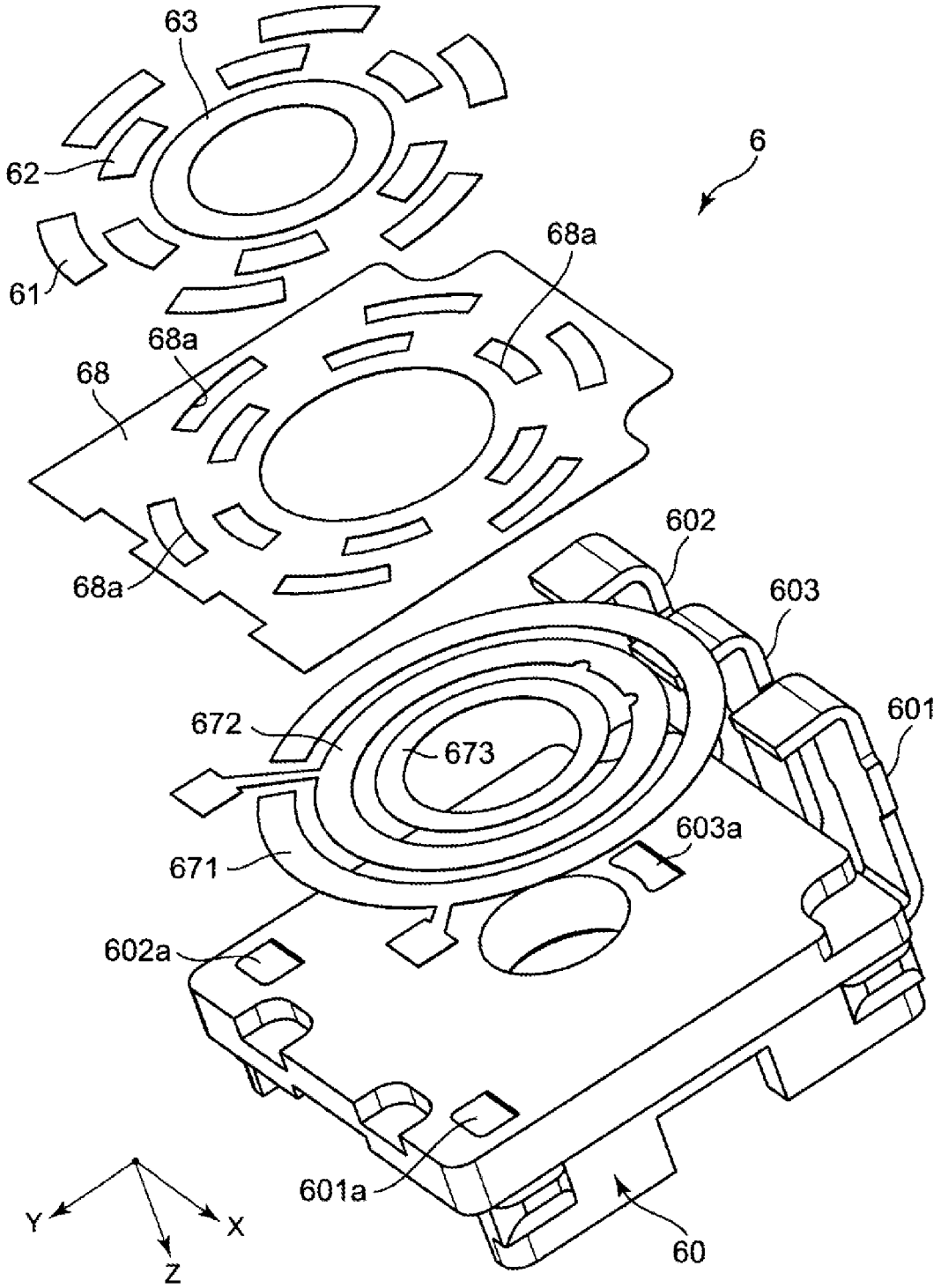
FIG. 6 is an exploded perspective view of an encoder mechanism viewed from below.

FIG. 6 is an exploded perspective view of the encoder mechanism 6 viewed from below. As shown in FIG. 6, first, second, and third electrode sections 671, 672, and 673 are provided on a bottom surface of the encoder board 60. The first electrode section 671, the second electrode section 672, and the third electrode section 673 have an annular shape, and are disposed concentrically. The first electrode section 671, the second electrode section 672, and the third electrode section 673 are disposed in this order from an outer side to an inner side in a radial direction. The first electrode section 671 is electrically connected to an end section 601*a* of the first encoder terminal 601. The second electrode section 672 is electrically connected to an end section 602*a* of the second encoder terminal 602. The third electrode section 673 is electrically connected to an end section 603*a* of the third encoder terminal 603.

An insulation sheet 68 is laminated on the first, second, and third electrode sections 671, 672, and 673. The insulation sheet 68 covers the first electrode section 671 and the second electrode section 672 such that the first electrode section 671 is intermittently exposed in a circumferential direction, and the second electrode section 672 is intermittently exposed in a circumferential direction. That is, the insulation sheet 68 includes a plurality of hole sections 68*a* disposed intermittently in a circumferential direction, and the first electrode section 671 and the second electrode section 672 are exposed through the hole sections 68*a* of the insulation sheet 68. The third electrode section 673 is not covered by the insulation sheet 68.

The first resistor pattern 61 is provided in a section in which the first electrode section 671 is exposed on the insulation sheet 68. The second resistor pattern 62 is provided in a section in which the second electrode section 672 is exposed on the insulation sheet 68. The third resistor pattern 63 is provided on the third electrode section 673.

In this manner, the first resistor pattern 61 is electrically connected to the first encoder terminal 601 through the first electrode section 671. The second resistor pattern 62 is electrically connected to the second encoder terminal 602 through the second electrode section 672. The third resistor pattern 63 is electrically connected to the third encoder terminal 603 through the third electrode section 673.

Figure 7:
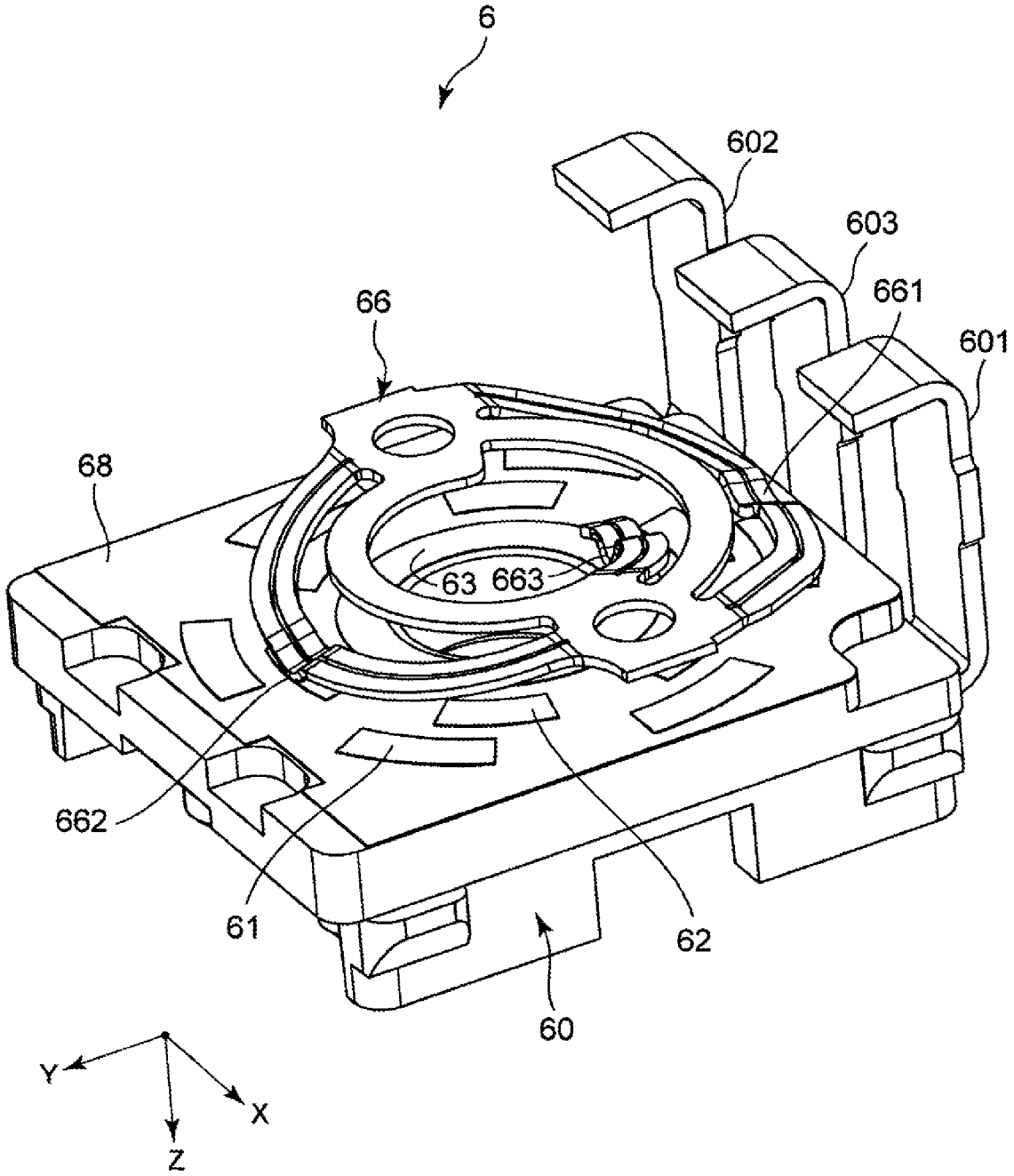
FIG. 7 is a perspective view of the encoder mechanism viewed from below.

FIG. 7 is a perspective view of the encoder mechanism 6 viewed from below. As shown in FIG. 7, the first contact section 661 of the slider 66 is at a position corresponding to the first resistor pattern 61. The second contact section 662 of the slider 66 is at a position corresponding to the second resistor pattern 62. The third contact section 663 of the slider 66 is at a position corresponding to the third resistor pattern 63.

By rotation of the slider 66, the first contact section 661 is in contact with the first resistor pattern 61 and the insulation sheet 68 alternately, and the second contact section 662 is in contact with the second resistor pattern 62 and the insulation sheet 68 alternately. The third contact section 663 is constantly in contact with the third resistor pattern 63. That is, by rotation of the slider 66, the first encoder terminal 601 and the third encoder terminal 603 are electrically connected intermittently, and the second encoder terminal 602 and the third encoder terminal 603 are electrically connected intermittently.

Figure 8:
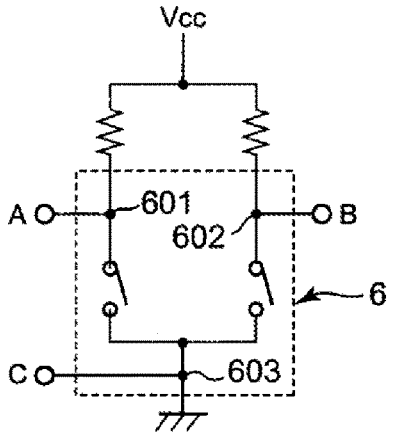
FIG. 8 is a circuit diagram showing an equivalent circuit of the encoder mechanism.
Figure 9:
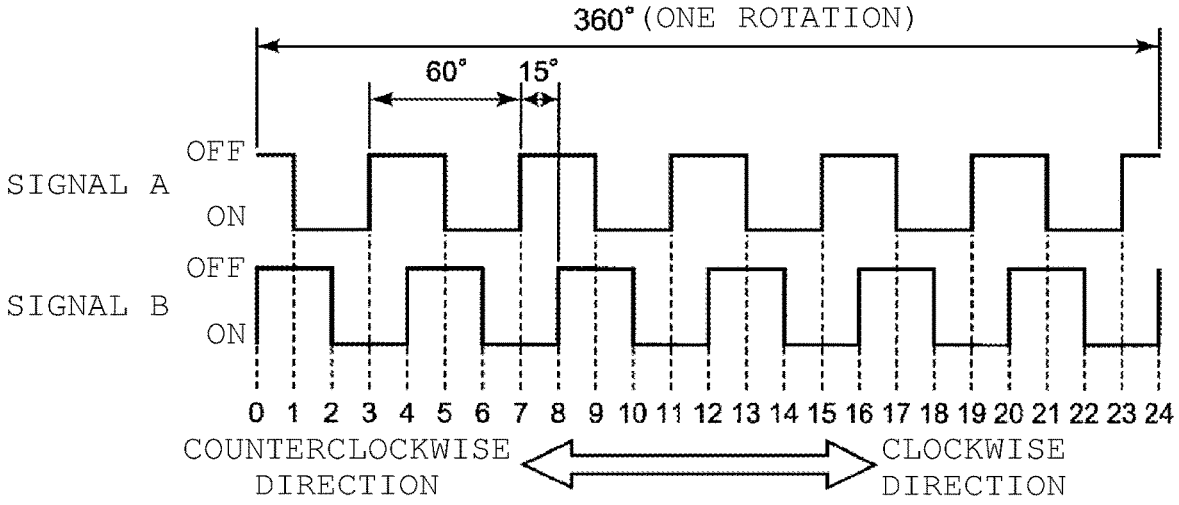
FIG. 9 is a waveform chart showing an output waveform of the encoder mechanism.

FIG. 8 is a circuit diagram showing an equivalent circuit of the encoder mechanism 6. FIG. 9 is a waveform chart showing an output waveform of the encoder mechanism 6. As shown in FIGS. 8 and 9, when the first encoder terminal 601 and the third encoder terminal 603 are electrically connected, an electric current flows between a point A and a point C, and a signal A becomes ON. When the second encoder terminal 602 and the third encoder terminal 603 are electrically connected, an electric current flows between a point B and the point C, and a signal B becomes ON.

In rotation in a clockwise direction of the slider 66, a rotation angle of the slider 66 from the start of OFF of the signal A to the start of next OFF is preferably about 60 deg, for example. This similarly applies to the signal B. A displacement between the start of OFF of the signal A and the start of OFF of the signal B is preferably about 15 deg, for example, in a rotation angle of the slider 66. In one rotation of the slider 66 (that is, when a rotation angle of the slider 66 is 360 deg), changes in combinations of ON and OFF of the signal A and the signal B are divided into 24 changes. That is, in one rotation of the slider 66, a rotation angle of the slider 66 is preferably determined to be changed by about 15 deg at a time, for example. Accordingly, by determining a change in the signal A and the signal B, a rotation direction and a rotation angle (rotation amount) of the slider 66 are able to be determined.

Figure 10:
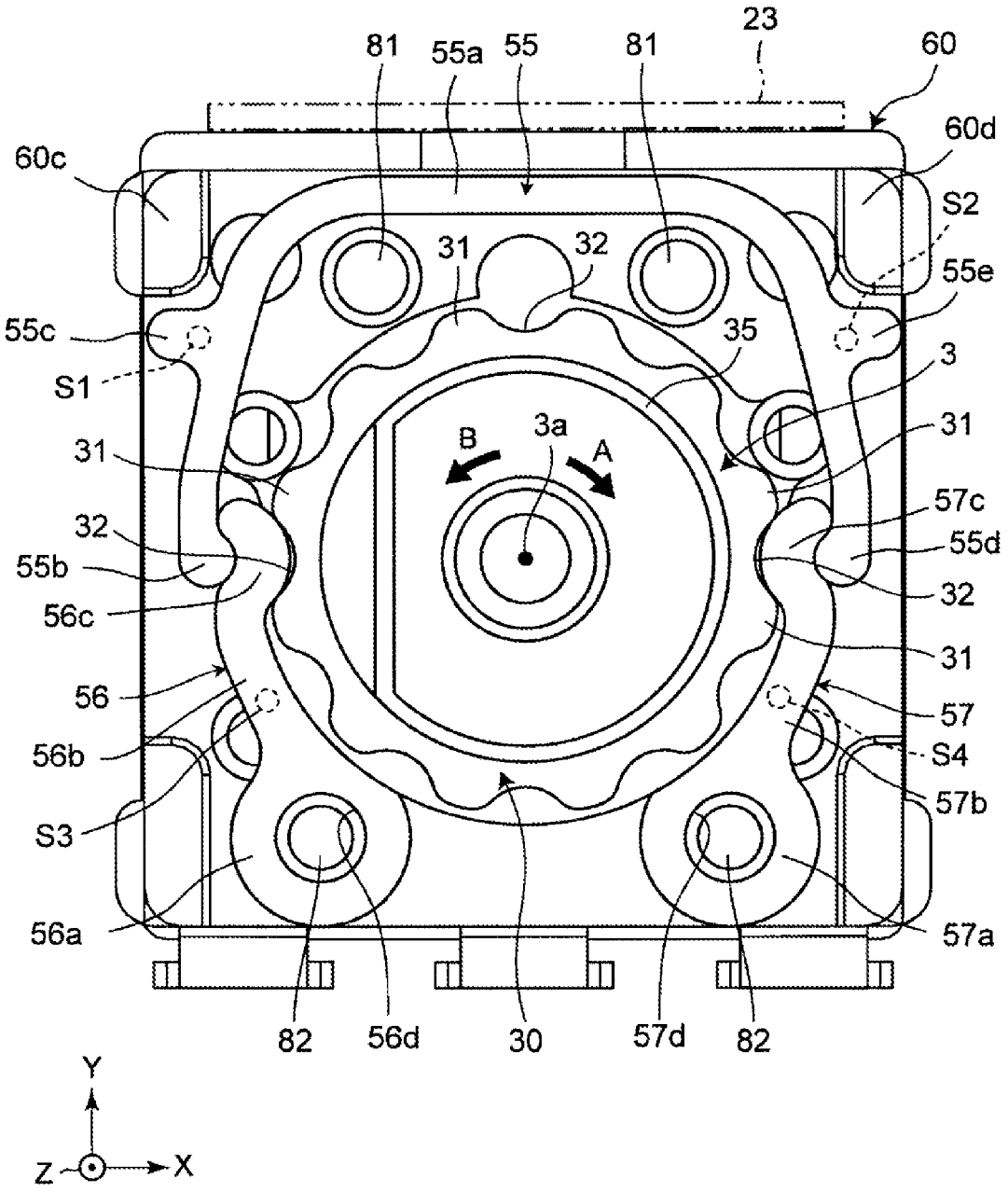
FIG. 10 is a plan view of an encoder board, a shaft, and first and second regulating members.
Figure 11:
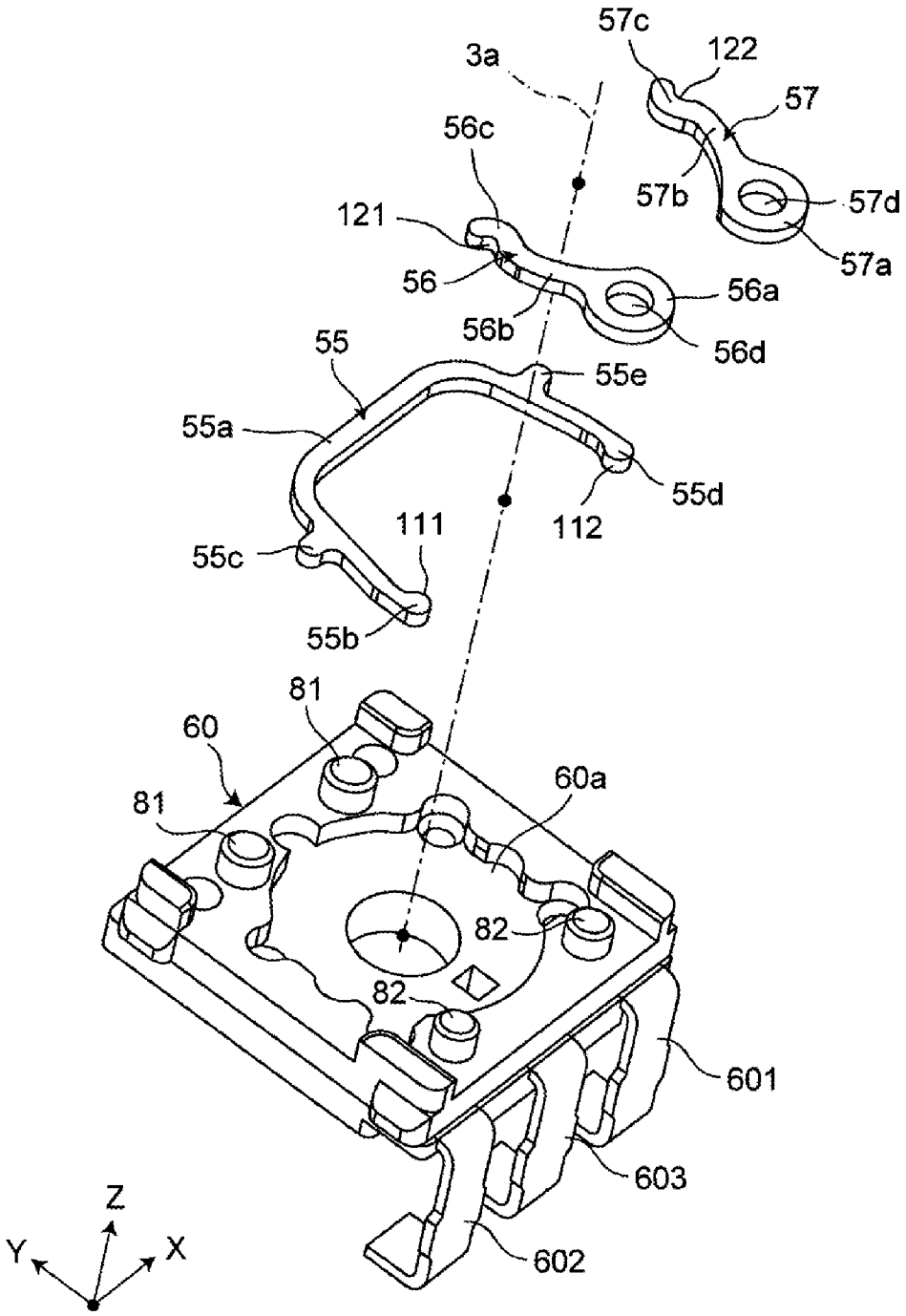
FIG. 11 is an exploded perspective view of the encoder board, a click spring, and a pendulum.

FIG. 10 is a plan view of the encoder board 60, the shaft 3, and the regulating member (the click spring 55 and the pendulums 56 and 57). FIG. 11 is an exploded perspective view of the encoder board 60 and the regulating member (the click spring 55 and the pendulums 56 and 57).

As shown in FIGS. 10 and 11, the regulating member (the click spring 55 and the pendulums 56 and 57) encloses the flange section 30 of the shaft 3 when viewed from an axis 3*a* direction of the shaft 3.

The pendulums 56 and 57 are preferably made from, for example, a rigid body, such as metal. The pendulums 56 and 57 include annular base sections 56*a* and 57*a* on which through-holes 56*d* and 57*d* are provided, arm sections 56*b* and 57*b* extending from the annular base sections 56*a* and 57*a*, and contact sections 56*c* and 57*c* provided at tips (free ends) of the arm sections 56*b* and 57*b*. The pendulums 56 and 57 are rotatably connected to the encoder board 60 in a state in which two hinge pins 82 provided on the top surface 60*a* of the encoder board 60 are inserted through the through-holes 56*d* and 57*d* of the pendulums 56 and 57. The contact section 56*c* of the pendulum 56 also defines and functions as a first locking section, and the contact section 57*c* of the pendulum 57 also defines and functions as a second locking section.

The pendulums 56 and 57 may be rotatably connected to the encoder board 60 by providing a pin on the pendulums 56 and 57 side and inserting the pin of the pendulums 56 and 57 into a hole provided on the encoder board 60.

The click spring 55 is provided on the top surface 60*a* of the encoder board 60 such that the entire or substantially the entire click spring 55 is movable within a predetermined range. The click spring 55 includes a base section 55*a*, a first locking section 55*b*, a stopper section 55*c*, a second locking section 55*d*, and a stopper section 55*e*. The base section 55*a* is elastically deformable, and has a U shape enclosing an outer periphery of the flange section 30. The first locking section 55*b* is provided at a first end of the base section 55*a* so as to be locked on the contact section 56*c* of the pendulum 56. The stopper section 55*c* protrudes to an outer side and is provided at the first end of the base section 55*a*. The second locking section 55*d* is provided at a second end of the base section 55*a* so as to be locked on the contact section 57*c* of the pendulum 57. The stopper section 55*e* protrudes to an outer side and is provided at the second end of the base section 55*a*.

Abutting sections 60*c* and 60*d* are provided at corner sections of the encoder board 60. The stopper section 55*c* of the click spring 55 is spaced apart from the abutting section 60*c* of the encoder board 60. The stopper section 55*e* of the click spring 55 is spaced apart from the abutting section 60*d* of the encoder board 60.

The first locking section 55*b* and the second locking section 55*d* of the click spring 55 include projecting surfaces 111 and 112 (curved surfaces) having an arc shape on radially inner sides of the shaft 3. On the other hand, the contact sections 56*c* and 57*c* of the pendulums 56 and 57 have recessed surfaces 121 and 122 (curved surfaces) having an arc shape and facing the first locking section 55*b* and the second locking section 55*d* of the click spring 55 on radially outer sides of the shaft 3.

The projecting surface 111, having an arc shape, of the first locking section 55*b* of the click spring 55 and the recessed surface 121, having an arc shape, on a radially outer side of the contact section 56*c* of the pendulum 56 are in contact with each other, so that the contact section 56*c* of the pendulum 56 is locked by the first locking section 55*b* of the click spring 55. The projecting surface 112, having an arc shape, of the second locking section 55*d* of the click spring 55 and the recessed surface 122, having an arc shape, on a radially outer side of the contact section 57*c* of the pendulum 57 are in contact with each other, so that the contact section 57*c* of the pendulum 57 is locked by the second locking section 55*d* of the click spring 55.

The contact sections 56*c* and 57*c* of the pendulums 56 and 57 are contactable with the flange section 30 (shown in FIG. 10) of the shaft 3. The contact sections 56*c* and 57*c* of the pendulums 56 and 57 are biased by the click spring 55 radially inwardly toward the shaft 3, so that the contact sections 56*c* and 57*c* are in contact with the projecting sections 31 of the flange section 30 of the shaft 3 and bias the projecting sections 31, or are fitted into the recessed sections 32 of the flange section 30 of the shaft 3 so as to regulate a rotation angle of the shaft 3.

Figure 12:
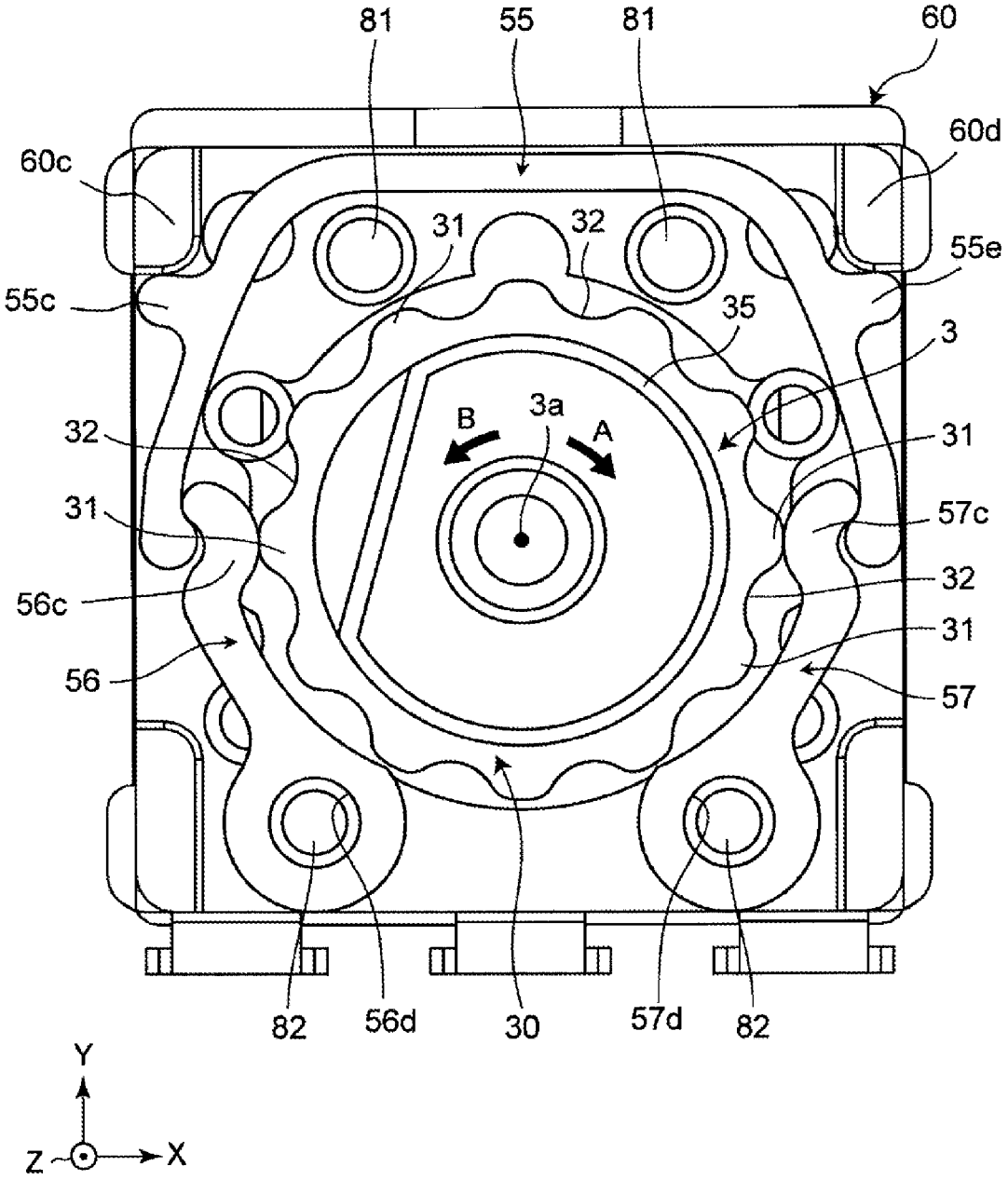
FIG. 12 is an explanatory view for explaining operation of a flange section of the shaft, the click spring, and the pendulum.

FIG. 12 is an explanatory view for explaining the operation of the flange section 30 of the shaft 3, the click spring 55, and the pendulums 56 and 57.

When the shaft 3 is rotated around the axis 3*a* from the state shown in FIG. 10 in which the contact sections 56*c* and 57*c* of the pendulums 56 and 57 are fitted into the recessed sections 32 of the flange section 30, the click spring 55 biases the contact sections 56*c* and 57*c* of the pendulums 56 and 57 radially inwardly toward the shaft 3 while the click spring 55 is elastically deformed. The pendulums 56 and 57 received an outward force from the projecting sections 31 of the flange section 30 and rotate toward an outer side around the hinge pins 82. In this manner, as shown in FIG. 12, the contact sections 56*c* and 57*c* of the pendulums and 57 come into contact with a zenith of the projecting sections 31 of the flange section 30. At this point, the stopper section 55*c* of the click spring 55 comes into contact with or close to the abutting section 60*c* of the encoder board 60, and the stopper section 55*e* of the click spring 55 comes into contact with or close to the abutting section 60*d* of the encoder board 60.

Thereafter, the contact sections 56*c* and 57*c* of the pendulums 56 and 57 move over the projecting sections 31 of the flange section 30, and are fitted into the recessed sections 32 of the flange section 30 again. At this time, the contact section 56*c* of the pendulum 56 and the contact section 57*c* of the pendulum 57 are simultaneously fitted into the recessed sections 32 and 32 positioned on opposite sides.

When the shaft 3 is rotated in a clockwise direction A, the contact section 56*c* of the pendulum 56 receives an outward force from the projecting section 31 of the flange section 30, and the pendulum 56 rotates counterclockwise around the hinge pin 82. On the other hand, when the shaft 3 is rotated in the clockwise direction A, the contact section 57*c* of the pendulum 57 receives an outward force from the projecting section 31 of the flange section 30, and the pendulum 57 rotates clockwise around the hinge pin 82.

Similarly, when the shaft 3 is rotated in a counterclockwise direction B, the contact section 56*c* of the pendulum 56 receives an outward force from the projecting section of the flange section 30, and the pendulum 56 rotates counterclockwise around the hinge pin 82. On the other hand, when the shaft 3 is rotated in a clockwise direction A, the contact section 57*c* of the pendulum 57 receives an outward force from the projecting section 31 of the flange section 30, and the pendulum 57 rotates clockwise around the hinge pin 82.

Two pins 81 are provided on the top surface 60*a* of the encoder board 60 and inner sides in a radial direction of the shaft 3 on the click spring 55. The pins 81 and the abutting sections 60*c* and 60*d* of the encoder board 60 regulate movements of the click spring 55 in the Y direction and the X direction. In this manner, the click spring 55 is provided on the encoder board 60 such that the entire or substantially the entire click spring 55 is movable within a predetermined range.

Next, description will be provided of a non-limiting example of an assembling method of the rotary encoder 1.

Figure 13A:
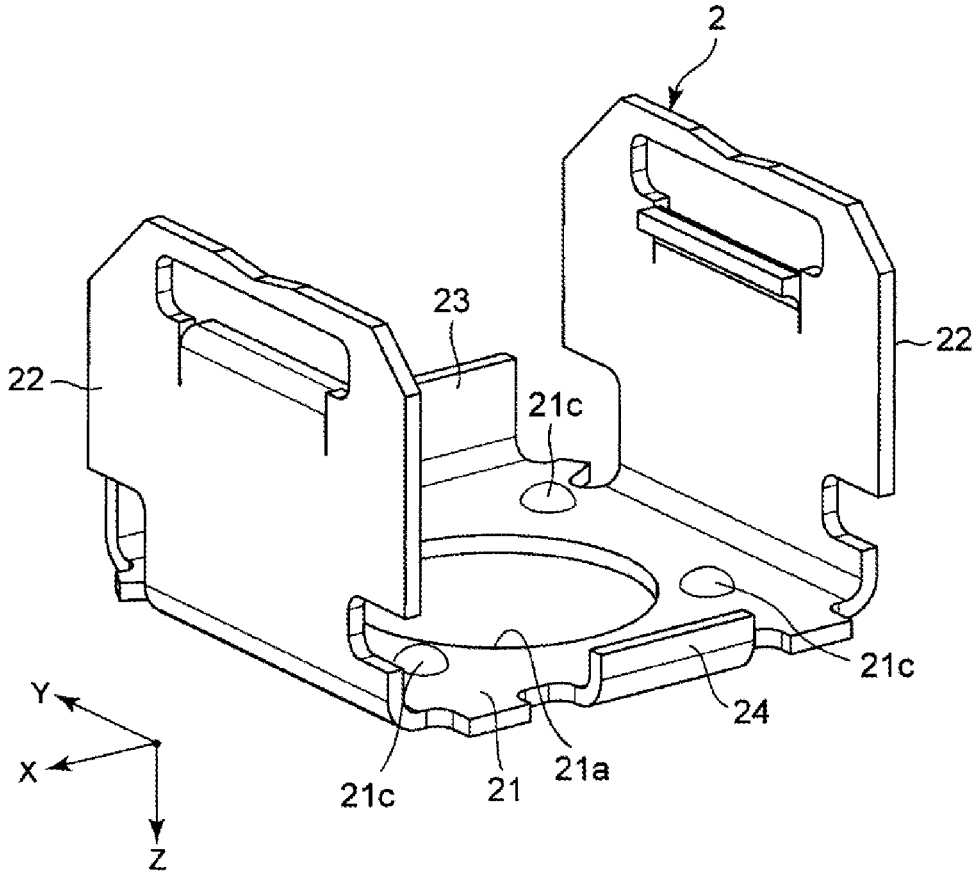
FIG. 13A is an explanatory view for explaining an assembling method of the rotary encoder.
Figure 13B:
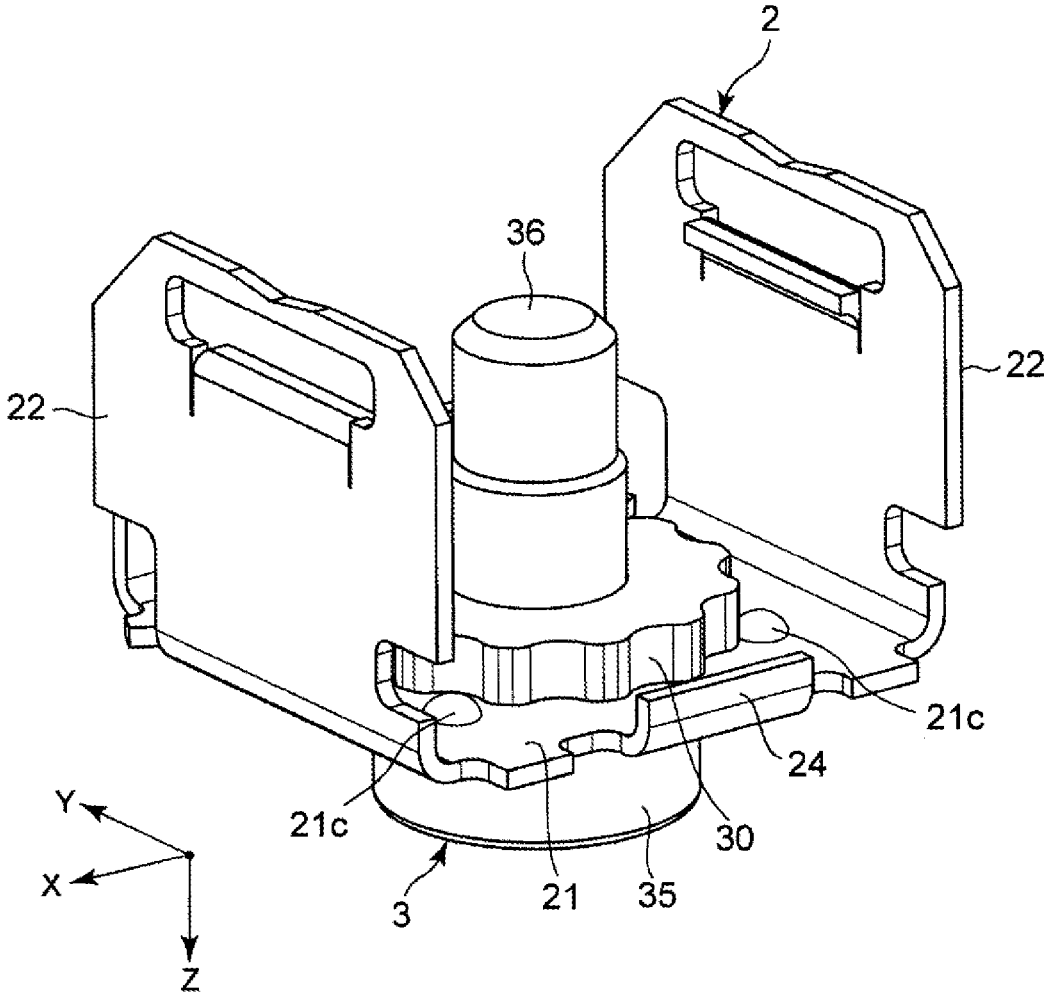
FIG. 13B is an explanatory view for explaining an assembling method of the rotary encoder.

As shown in FIG. 13A, the casing 2 is set reversely so that the upper wall 21 is disposed downward. As shown in FIG. 13B, the operation section 35 of the shaft 3 is inserted through the hole section 21*a* of the upper wall 21 so as to install the shaft 3 in the casing 2. In FIGS. 13A and 13B, reference character 21*c* is a projecting section which protrudes in a negative direction in the Z direction due to four of the recessed sections 21*b* (shown in FIG. 1) provided on the upper wall 21 of the casing 2.

The four projecting sections 21*c* abut an area S1 including the stopper section 55*c* of the click spring 55, an area S2 including the stopper section 55*e*, an area S3 of the pendulum 56, and an area S4 of the pendulum 57 shown in FIG. 10. In this manner, a movement of the click spring 55 in an axial direction of the shaft 3 is regulated. The four projecting sections 21*c* provided on the casing 2 are an example of a movement regulating member.

By adjusting a thickness in the Z direction of the click spring 55, a rotational torque is able to be adjusted to adjust click feeling in accordance with uses. In this case, a height in a negative direction in the Z direction of the four projecting sections 21*c* is changed as appropriate in accordance with a thickness in the Z direction of the click spring 55, so that a movement of the click spring 55 in an axial direction of the shaft 3 is able to be easily regulated.

Figure 13C:
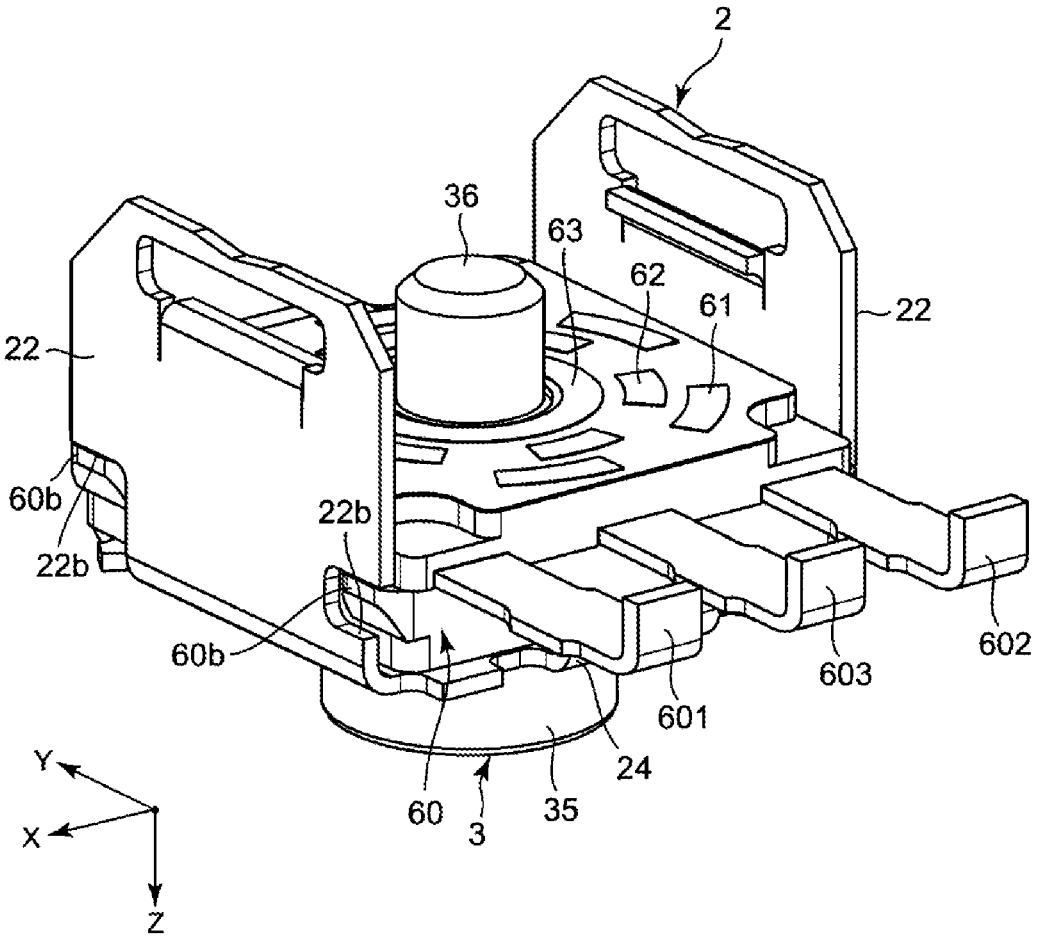
FIG. 13C is an explanatory view for explaining an assembling method of the rotary encoder.

As shown in FIG. 13C, the encoder board 60 on which the resistor patterns 61, 62, and 63 and the regulating member (the click spring 55 and the pendulums 56 and 57) are provided is installed on the casing 2 by inserting the end section 36 of the shaft 3 in the encoder board 60. At this time, the protruding section 60*b* of the encoder board 60 is fitted into the groove section 22*b* on the side wall 22 of the casing 2. Both sides in the Y direction of the encoder board 60 are sandwiched by the protruding wall 23 and the protruding piece 24 of the casing 2. The encoder terminals 601, 602, and 603 are not folded except at an end section.

Figure 13D:
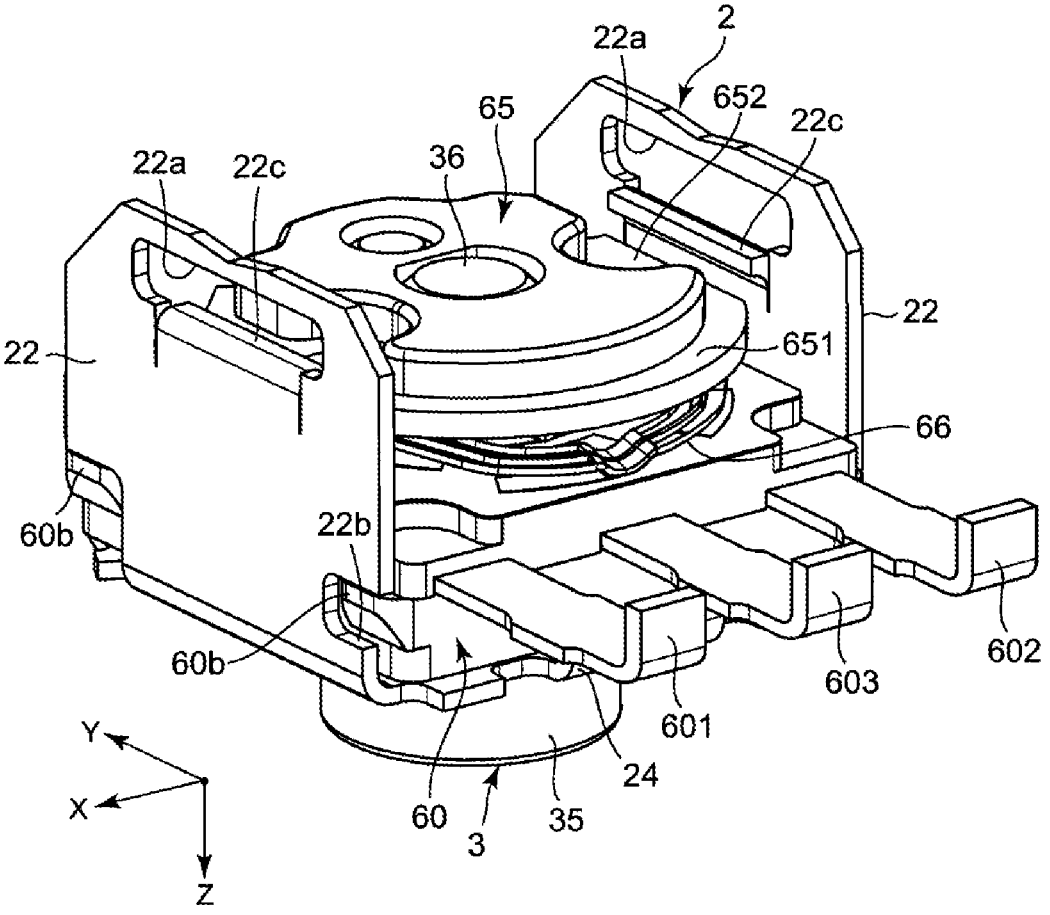
FIG. 13D is an explanatory view for explaining an assembling method of the rotary encoder.

As shown in FIG. 13D, the rotor 65 is installed on the casing 2 by inserting the end section 36 of the shaft 3 in the rotor 65. At this time, the smaller diameter section 652 of the rotor 65 is able to pass through the locking section 22*c* of the side wall 22 of the casing 2 so that the rotor 65 is assembled with the casing 2. Since the smaller diameter section 652 is not locked by the locking section 22*c*, assembling the rotor 65 with the casing 2 is facilitated.

Figure 13E:
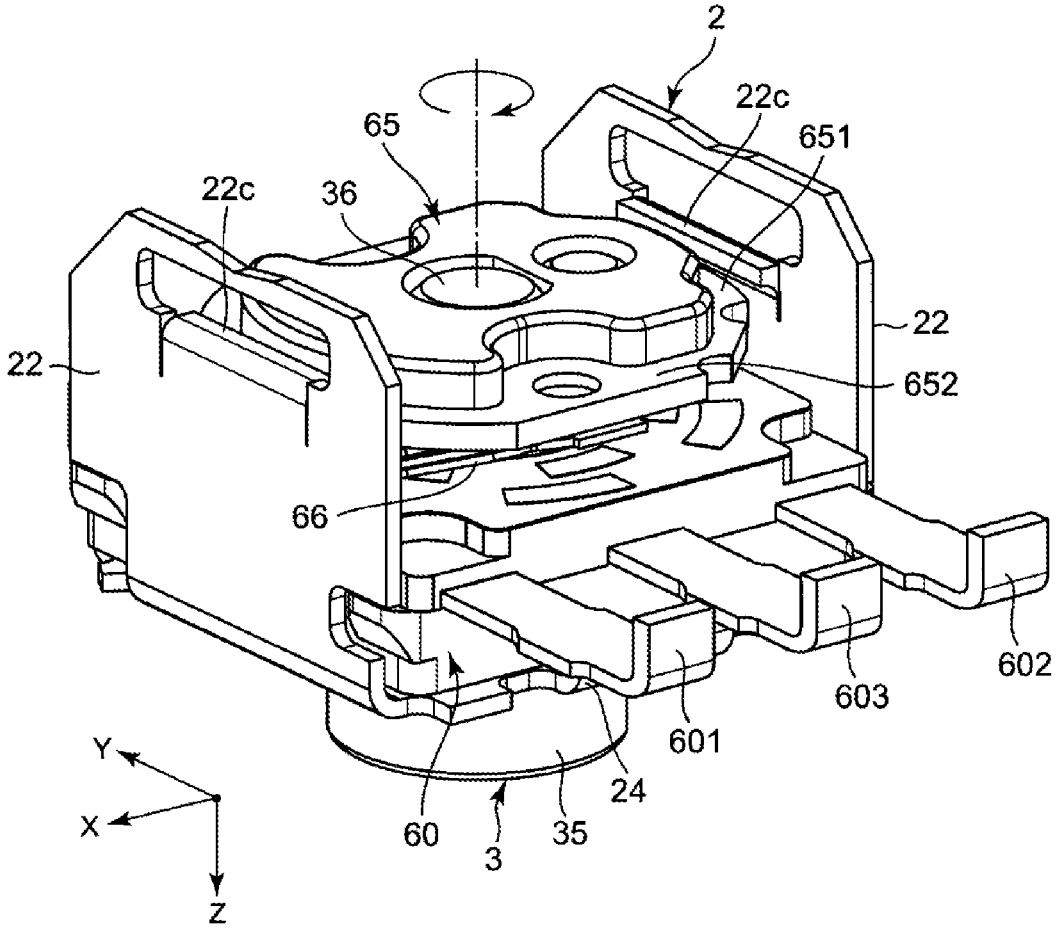
FIG. 13E is an explanatory view for explaining an assembling method of the rotary encoder.

As shown in FIG. 13E, after the rotor 65 is assembled with the casing 2, the operation section 35 of the shaft 3 is operated to rotate the rotor 65, and the larger diameter section 651 of the rotor 65 is locked by the locking sections 22*c* of the side wall 22 of the casing 2. Since the larger diameter section 651 is locked by the locking sections 22*c* by rotation of the rotor 65, a state in which the rotor 65 is assembled with the casing 2 is maintained.

Figure 13F:
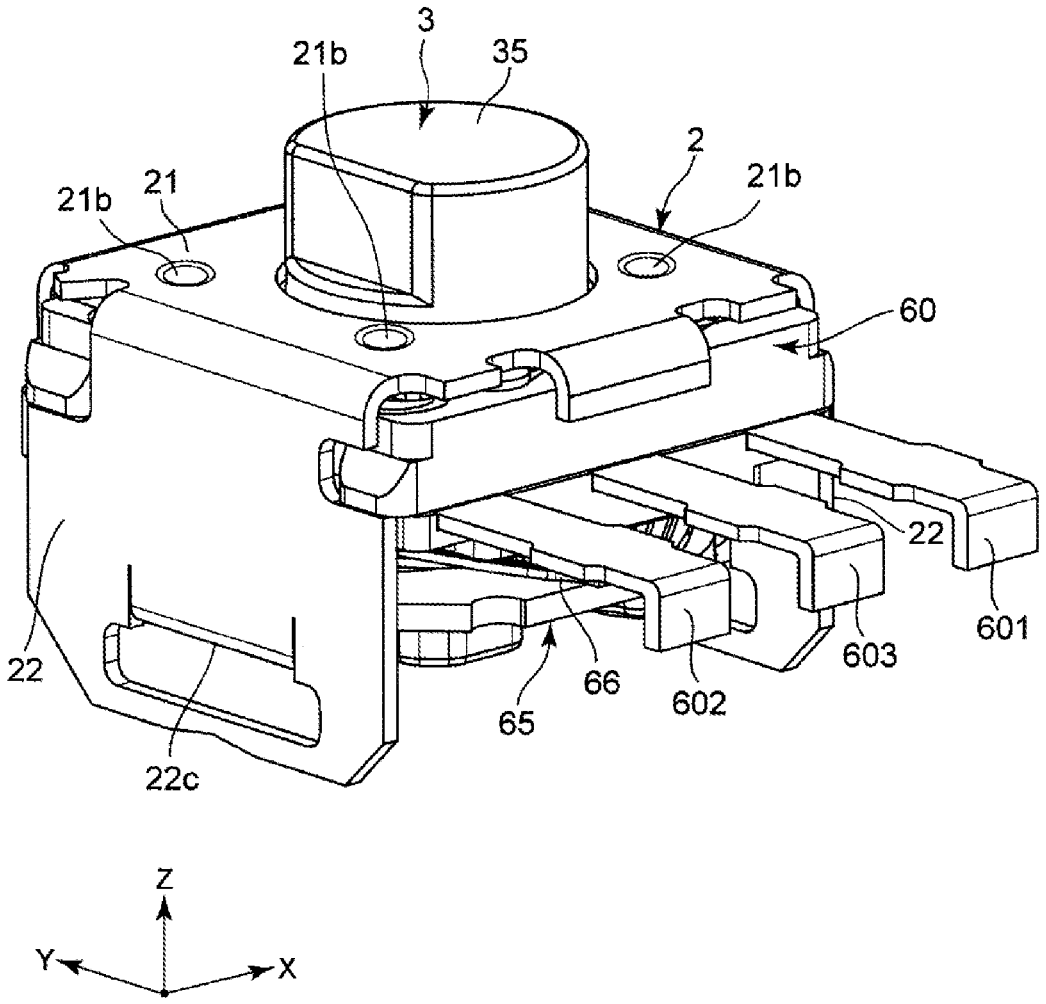
FIG. 13F is an explanatory view for explaining an assembling method of the rotary encoder.

As shown in FIG. 13F, the casing 2 is reversed so that the upper wall 21 is positioned upward. At this time, the rotor 65 does not fall downward since the rotor 65 is locked by the locking sections 22*c* on the side wall 22 of the casing 2.

Figure 13G:
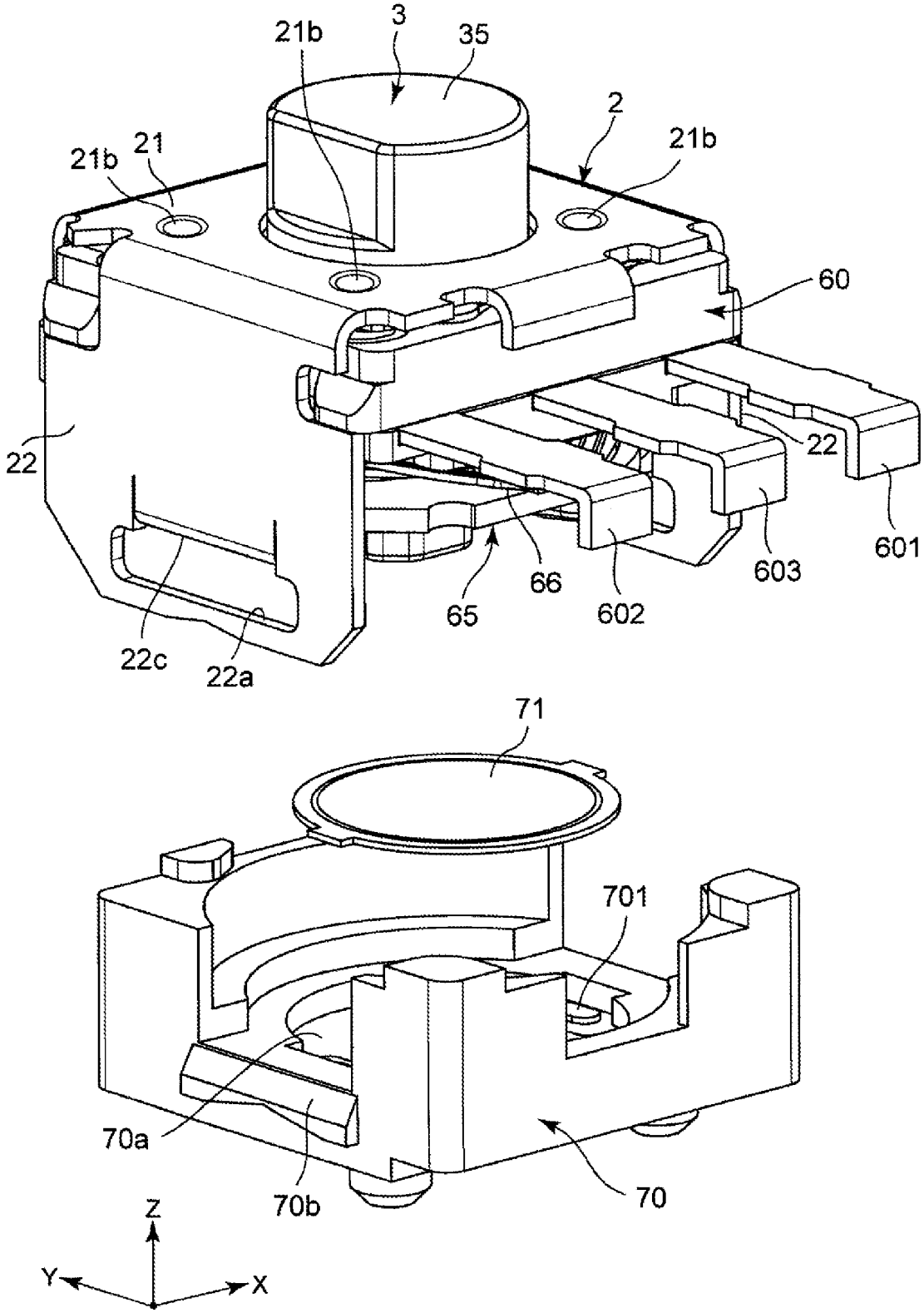
FIG. 13G is an explanatory view for explaining an assembling method of the rotary encoder.

As shown in FIG. 13G, the conductor 71 is fitted into the recessed section 70*a* of the switch board 70 on which the switch terminals 701, 702, and 703 are provided, and the casing 2 is attached to the switch board 70 from an upper side of the switch board 70. In this manner, the casing 2 is attached to the switch board 70 in a state in which the conductor 71 is fitted in the recessed section 70*a* of the switch board 70.

Figure 13H:
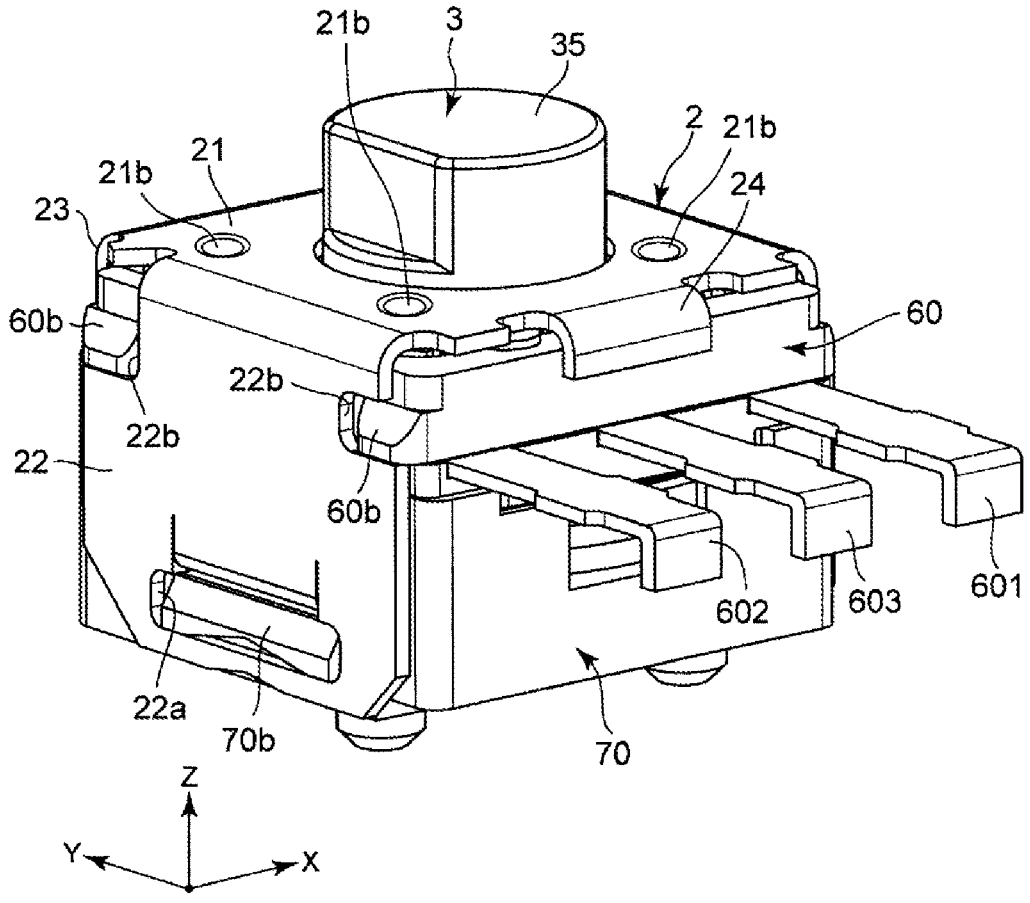
FIG. 13H is an explanatory view for explaining an assembling method of the rotary encoder.

As shown in FIG. 13H, the protruding section 70*b* of the switch board 70 is fitted into the hole section 22*a* of the side wall 22 of the casing 2, so that the switch board 70 is fixed to the casing 2. As described above, the encoder board 60 is fixed to the hole section 22*a* of the side wall 22 as an encoder fixing section of the casing 2, and the switch board 70 is fixed to the groove section 22*b*, the protruding wall 23, and the protruding piece 24 on the side wall 22 as switch fixing sections of the casing 2. In this manner, the encoder board 60 and the switch board 70 are integrated using the casing 2. Accordingly, a joint strength of the encoder board 60 and the switch board 70 is improved without increasing the number of components.

Figure 13I:
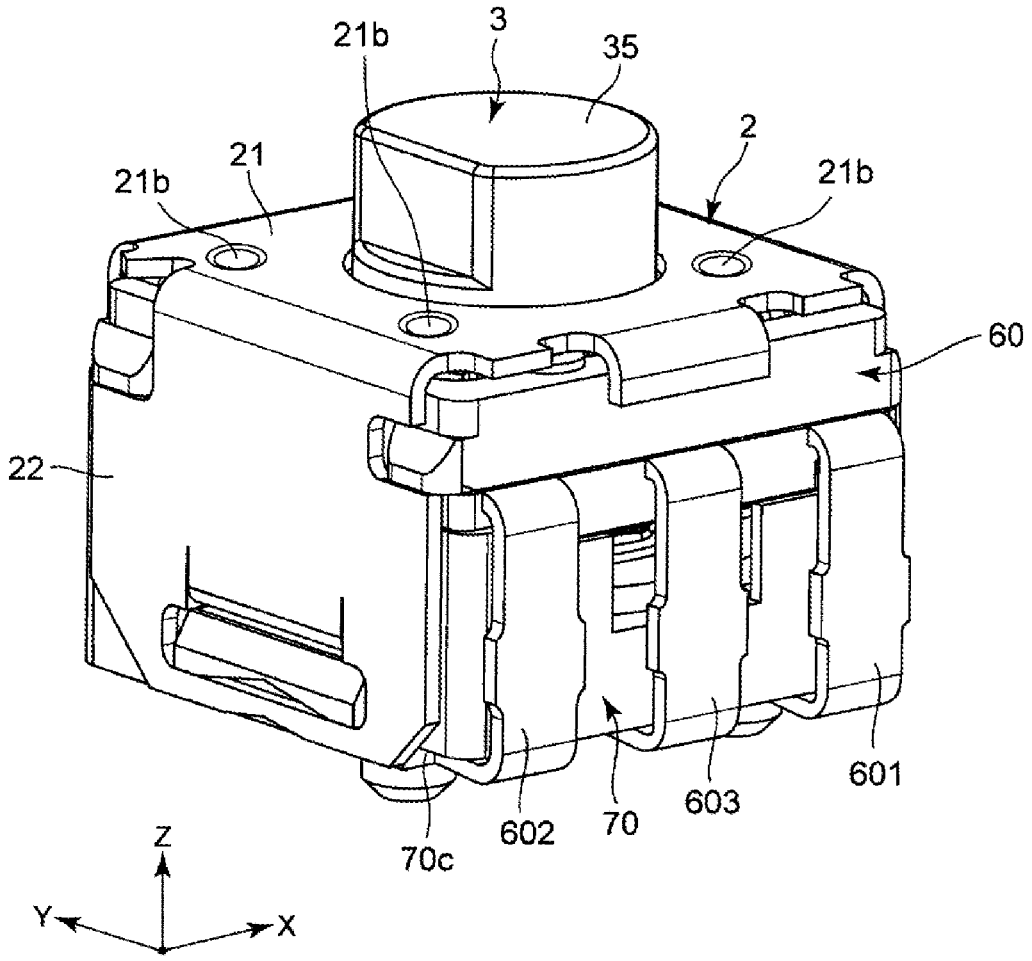
FIG. 13I is an explanatory view for explaining an assembling method of the rotary encoder.

As shown in FIG. 13I, sections of the encoder terminals 601, 602, and 603 protruding from the encoder board 60 are folded, so that end sections of the encoder terminals 601, 602, and 603 are locked on the step section 70*c*. In this manner, the encoder board 60 and the switch board 70 are held integrally by the encoder terminals 601, 602, and 603 which are folded. In this manner, the encoder board 60 and the switch board 70 is integrated using the encoder terminals 601, 602, and 603. Accordingly, a joint strength of the encoder board 60 and the switch board 70 is improved without increasing the number of components.

A torque change with respect to a rotation angle of the shaft 3 of the rotary encoder 1 of the present preferred embodiment was measured by experiment. As a result, a torque change accompanying a rotation in a clockwise direction of the shaft 3 was smooth, and excellent click feeling was obtained.

Similarly, a torque change with respect to a rotation angle of the shaft 3 was measured by experiment. As a result, a torque change accompanying a rotation in a counterclockwise direction of the shaft 3 of the rotary encoder 1 was smooth, and excellent click feeling was obtained.

As described above, in the rotary encoder 1, since behaviors of the pendulums 56 and 57 are synchronous, similar click feeling is obtained whether the shaft 3 is rotated clockwise or counterclockwise.

According to the rotary encoder 1 of the present preferred embodiment, the regulating member (the click spring 55 and the pendulums 56 and 57) that regulates a rotation angle of the shaft 3 is reduced in size with a simple configuration. As a result, a reduction in size of the rotary encoder 1 is achieved. The regulating member (the click spring 55 and the pendulums 56 and 57) regulates a rotation angle of the shaft 3 by using the flange section 30 of the shaft 3. Accordingly, a function of regulating a rotation angle of the shaft 3 is not provided to a portion of the encoder mechanism 6 (for example, the rotor 65). For this reason, the encoder mechanism 6 (particularly the rotor 65) does not need to be large, and a reduction in size of the rotary encoder 1 is achieved.

In the state shown in FIG. 10, the click spring 55 and the pendulums 56 and 57 are plane-symmetric with respect to a plane that passes through the axis 3*a* of the shaft 3 along the Y direction. In this manner, when a rotation direction of the shaft 3 is changed from a clockwise direction to a counterclockwise direction, behaviors of the pendulums 56 and 57 are synchronous. Accordingly, similar click feelings are obtained whether the shaft 3 is rotated clockwise or counterclockwise.

First ends of the pendulums 56 and 57 are rotatably connected to the encoder board 60, second ends of the pendulums 56 and 57 are free ends in contact with the projecting section 31 and the recessed section 32 of the shaft 3, and the click spring 55 is locked on the free end of the pendulums 56 and 57. Accordingly, the free ends of the pendulums 56 and 57 are restricted to rotate on an arc, and behaviors of the pendulums 56 and 57 accompanying rotation of the shaft 3 is stabilized. In this manner, smooth click feeling is obtained.

As described above, the pendulums 56 and 57 only rotate along with rotation of the shaft 3, and do not need to be deformed elastically. For this reason, the pendulums 56 and 57 are able to be made from a rigid body, such as metal, for example. Accordingly, the strength of the pendulums 56 and 57 and the shaft 3 is improved by the pendulums 56 and 57 and the shaft 3 being made from metal, and reliability is improved.

The click spring 55 including the base section 55*a* which is elastically deformable and the first and second locking sections 55*b* and 55*d* locked on free ends of the pendulums 56 and 57 biases the pendulums 56 and 57 radially inwardly toward the shaft 3, so that the pendulums 56 and 57 are in contact with the projecting section 31 and the recessed section 32 of the flange section 30 from both sides of the shaft 3. Accordingly, smooth click feelings are obtained similarly in all rotation directions of the shaft 3.

The pendulums 56 and 57 are disposed at positions that are plane-symmetric with respect to a plane passing through the axis of the shaft 3, the projecting sections 31 of the flange section 30 of the shaft 3 are disposed at positions that are plane-symmetric with respect to a plane passing through the axis of the shaft 3, and the recessed sections 32 of the flange section 30 of the shaft 3 are disposed at positions that are plane-symmetric with respect to a plane passing through the axis of the shaft 3. In this manner, states of the pendulums 56 and 57 in contact with the projecting sections 31 and the recessed sections 32 of the flange section 30 of the shaft 3 are synchronous. Accordingly, a smoother click feeling is obtained.

The click spring 55 is provided on the encoder board 60 such that the entire or substantially the entire click spring 55 is movable within a predetermined range. Accordingly, as the entire click spring 55 is elastically deformed in a flexible manner along with rotation of the shaft 3, concentration of stress to the click spring 55 is reduced, and a fatigue fracture of the click spring 55 caused by repetition of elastic deformation is prevented.

The click spring 55 and the pendulums 56 and 57 of the regulating member, are locked with curved surfaces (the projecting surfaces 111 and 112 and the recessed surfaces 121 and 122) in contact with each other. In this manner, a contact area between the click spring 55 and the pendulums 56 and 57 is increased. As a result, a surface pressure is reduced, wear of a contact surface between the contact member and the pendulums 56 and 57 is reduced, and reliability is improved.

The four projecting sections 21*c* (movement regulating members) provided on the upper wall 21 of the casing 2 regulate a movement of the regulating member (the click spring 55 and the pendulums 56 and 57) in an axial direction of the shaft 3. Accordingly, the regulating member (the click spring 55 and the pendulums 56 and 57) does not move irregularly in an axial direction of the shaft 3 along with rotation of the shaft 3, and has stabilized.

The rotary encoder 1 includes the regulating member (the click spring 55 and the pendulums 56 and 57) that regulates a rotation angle of the shaft 3, the encoder mechanism 6 that detects a rotation direction and a rotation angle of the shaft 3, and the switch mechanism 7 that is pressed against the shaft 3 by movement along an axis of the shaft 3. In this manner, the shaft 3 by itself controls a click function of the regulating member (the click spring 55 and the pendulums 56 and 57), an encoder function of the encoder mechanism 6, and a switch function of the switch mechanism 7. Accordingly, the shaft 3 by itself controls three of the functions in an integral manner, and a reduction in size of the rotary encoder 1 is achieved.

The rotor 65 does not restrict an axial behavior of the shaft 3. In this manner, when the shaft 3 is pressed to the switch mechanism 7, and when, after being pressed as described above, the shaft 3 is pushed back by the conductor 71, the shaft 3 slides through the hole section 65*a* of the rotor 65, and does not pull the rotor 65. For this reason, the slider 66 is not deformed by being pressed by the resistor patterns 61, 62, and 63. In addition, the slider 66 is not separated from the resistor patterns 61, 62, or 63, and no conduction failure is generated.

The regulating member (the click spring 55 and the pendulums 56 and 57) and the resistor patterns 61, 62, and 63 are positioned on opposite sides with respect to the encoder board 60. In this manner, even when wear debris is generated from the flange section 30 of the shaft 3 due to contact between the regulating member (the click spring 55 and the pendulums 56 and 57) and the flange section 30 of the shaft 3, the wear debris is blocked by the encoder board 60 and does not enter the resistor patterns 61, 62, and 63 side. Accordingly, deterioration in an electric characteristic of the encoder mechanism 6 caused by wear debris is prevented.

The present invention is not limited to the above-described preferred embodiments, and the design may be changed within a range without deviating from the gist of the present invention.

In the above-described preferred embodiments, description is provided of a rotary encoder as an example of a rotary electronic component. However, the rotary electronic component of the present invention is not limited to a rotary encoder. Preferred embodiments of the present invention are applicable to other rotary electronic components, such as a potentiometer and a trimmer capacitor, for example.

In the above-described preferred embodiments, description is provided of the rotary encoder including the regulating member including the click spring 55 (biasing member) and the pendulums 56 and 57 (contact members). Preferred embodiments of the present invention may also be applied to, for example, a rotary electronic component that includes a regulating member including one contact member in contact with a projecting section and a recessed section of a flange section of a shaft and one biasing member that biases the contact member radially inwardly toward the shaft.

In the above-described preferred embodiments, description is provided of the rotary encoder in which the click spring 55 (biasing member) and free ends of the pendulums 56 and (contact members) are in contact with each other on curved surfaces, so that the click spring 55 is locked. Alternatively, the biasing member may be locked on the free end of the contact member in a state in which the biasing member is connected by a rotation shaft.

In the above-described preferred embodiments, the shaft 3 and the pendulums 56 and 57 (contact members) are preferably made from metal, and the click spring 55 (biasing member) is preferably made from wear-resistant resin, for example. Alternatively, the shaft and the contact members may be made from rigid and wear-resistant resin, for example.

In the above-described preferred embodiments, the switch mechanism 7 is provided. However, the switch mechanism may be omitted. The flange section is provided integrally with the shaft. However, an axis section of the shaft may be separate from the flange section.

In the above-described preferred embodiments, the regulating member, the encoder mechanism, and the switch mechanism are disposed in this order from an upper side to a lower side along the axis of the shaft. The order of the regulating member, the encoder mechanism, and the switch mechanism along the axis of the shaft may be changed.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A rotary electronic component, comprising:

a base member;

a shaft attached to the base member so as to be rotatable around an axis; and a regulating member that regulates a rotation angle of the shaft; wherein the shaft includes a flange section including a plurality of projecting sections and a plurality of recessed sections alternately disposed in a circumferential direction;

the regulating member includes:

a contact member in contact with the projecting sections and the recessed sections of the flange section of the shaft; and a biasing member that biases the contact member radially inwardly toward the shaft;

the contact member includes a first end rotatably connected to the base member, and a second free end in contact with the projecting sections and the recessed sections of the shaft; and the biasing member is locked on the second free end of the contact member.

2. The rotary electronic component according to claim 1, wherein the contact member of the regulating member includes a first contact member and a second contact member disposed on opposed sides of the shaft;

the biasing member of the regulating member includes:

a base section which is elastically deformable;

a first locking section provided at a first end of the base section so as to be locked on the second free end of the first contact member; and a second locking section provided at a second end of the base section so as to be locked on the second free end of the second contact member.

3. The rotary electronic component according to claim 2, wherein the first contact member and the second contact member of the regulating member are disposed at positions that are plane-symmetric with respect to a plane passing through an axis of the shaft.

4. The rotary electronic component according to claim 3, wherein the projecting sections of the flange section of the shaft are disposed at positions that are plane-symmetric with respect to the plane passing through an axis of the shaft; and the recessed sections of the flange section of the shaft are disposed at positions that are plane-symmetric with respect to the plane passing through an axis of the shaft.

5. The rotary electronic component according to claim 2, wherein the biasing member of the regulating member is provided on the base member such that an entirety or substantially an entirety of the biasing member is movable within a predetermined range.

6. The rotary electronic component according to claim 1, wherein the contact member and the biasing member of the regulating member are locked on curved surfaces in contact with each other.

7. The rotary electronic component according to claim 1, further comprising a movement regulating member that regulates a movement of the regulating member in an axial direction of the shaft.

8. The rotary electronic component according to claim 1, further comprising a casing in which the base member, the shaft, and the regulating member are housed.

9. The rotary electronic component according to claim 8, wherein the casing is made of metal.

10. The rotary electronic component according to claim 1, wherein the shaft is made of resin.

11. The rotary electronic component according to claim 1, wherein the shaft further includes an operation section and an end section; and the operation section, the flange section, and the end section are disposed in this order.

12. The rotary electronic component according to claim 11, wherein the operation section includes a notch defining a mark for rotation of the shaft.

13. The rotary electronic component according to claim 11, further comprising:

a casing including a hole in an upper surface thereof; wherein the operation section extends through the hole such that a user is able to operate the operation section from outside the casing.

14. The rotary electronic component according to claim 1, further comprising:

an encoder mechanism including an encoder board; wherein the base member is defined by the encoder board.

15. The rotary electronic component according to claim 14, wherein the encoder mechanism includes a rotor attached to the shaft.

16. The rotary electronic component according to claim 14, wherein the encoder board is made of resin.

17. The rotary electronic component according to claim 14, wherein the regulating member is attached to a top surface of the encoder board.

* * * * *